US010301882B2

(12) United States Patent
Mukhopadhyay et al.

(10) Patent No.: US 10,301,882 B2
(45) Date of Patent: May 28, 2019

(54) POLYCRYSTALLINE DIAMOND COMPACTS

(71) Applicant: US SYNTHETIC CORPORATION, Orem, UT (US)

(72) Inventors: Debkumar Mukhopadhyay, Sandy, UT (US); Kenneth E. Bertagnolli, Riverton, UT (US); Jair J. Gonzalez, Provo, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

(21) Appl. No.: 14/178,118

(22) Filed: Feb. 11, 2014

(65) Prior Publication Data

US 2014/0158437 A1 Jun. 12, 2014

Related U.S. Application Data

(63) Continuation of application No. 12/961,787, filed on Dec. 7, 2010.

(51) Int. Cl.
*E21B 10/573* (2006.01)
*E21B 10/567* (2006.01)
(Continued)

(52) U.S. Cl.
CPC ..... *E21B 10/5735* (2013.01); *B22F 7/06* (2013.01); *B24D 3/10* (2013.01); *C22C 26/00* (2013.01);
(Continued)

(58) Field of Classification Search
None
See application file for complete search history.

(56) References Cited

U.S. PATENT DOCUMENTS 2,349,577 A 5/1944 Dean
3,743,489 A 7/1973 Wentorf, Jr. et al.
(Continued)

FOREIGN PATENT DOCUMENTS

EP 0 297 071 12/1988
EP 0 352 811 1/1990
(Continued)

OTHER PUBLICATIONS

U.S. Appl. No. 14/297,359, filed Jun. 5, 2014, Miess et al.
(Continued)

*Primary Examiner* — Kaj K Olsen
*Assistant Examiner* — Ross J Christie
(74) *Attorney, Agent, or Firm* — Dorsey & Whitney LLP

(57) ABSTRACT

In an embodiment, a polycrystalline diamond compact includes a substrate, and a polycrystalline diamond ("PCD") table bonded to the substrate and including an exterior working surface, at least one lateral surface, and a chamfer extending between the exterior working surface and the at least one lateral surface. The PCD table includes bonded diamond grains defining interstitial regions. The PCD table includes a first region adjacent to the substrate and a second leached region adjacent to the first region and extending inwardly from the exterior working surface to a selected depth. At least a portion of the interstitial regions of the first region include an infiltrant disposed therein. The interstitial regions of the second leached region are substantially free of metal-solvent catalyst. The second region is defined by the exterior working surface, the lateral surface, the chamfer, and a generally horizontal boundary located below the chamfer.

11 Claims, 10 Drawing Sheets

(51) Int. Cl.

| | |
|---|---|
| ***E21B 10/55*** | (2006.01) |
| ***C22C 26/00*** | (2006.01) |
| ***B24D 3/10*** | (2006.01) |
| ***B22F 7/06*** | (2006.01) |
| *B22F 5/00* | (2006.01) |

(52) U.S. Cl.

CPC ..... *E21B 10/55* (2013.01); *E21B 10/567* (2013.01); *B22F 2005/001* (2013.01); *Y10T 428/24777* (2015.01)

(56) References Cited

U.S. PATENT DOCUMENTS

| | | | |
|---|---|---|---|
| 3,745,623 | A | 7/1973 | Wentorf, Jr. et al. |
| 3,767,371 | A | 10/1973 | Wentorf, Jr. et al. |
| 3,786,552 | A | 1/1974 | Saito et al. |
| 3,918,219 | A | 11/1975 | Wentorf, Jr. et al. |
| 4,009,027 | A | 2/1977 | Naidich et al. |
| 4,016,736 | A | 4/1977 | Carrison et al. |
| 4,063,909 | A | 12/1977 | Mitchell |
| 4,084,942 | A | 4/1978 | Villalobos |
| 4,191,735 | A | 3/1980 | Nelson et al. |
| 4,224,380 | A | 9/1980 | Bovenkerk et al. |
| 4,268,276 | A | 5/1981 | Bovenkerk |
| 4,274,900 | A | 6/1981 | Mueller et al. |
| 4,288,248 | A | 9/1981 | Bovenkerk et al. |
| 4,333,902 | A | 6/1982 | Hara |
| 4,410,054 | A | 10/1983 | Nagal et al. |
| 4,440,573 | A | 4/1984 | Ishizuka |
| 4,460,382 | A | 7/1984 | Ohno |
| 4,468,138 | A | 8/1984 | Nagel |
| 4,525,179 | A | 6/1985 | Gigl |
| 4,560,014 | A | 12/1985 | Geczy |
| 4,676,124 | A | 6/1987 | Fischer |
| 4,692,418 | A | 9/1987 | Boecker et al. |
| 4,738,322 | A | 4/1988 | Hall et al. |
| 4,766,027 | A | 8/1988 | Burn et al. |
| 4,778,486 | A | 10/1988 | Csillag et al. |
| 4,783,245 | A | 11/1988 | Nakamura et al. |
| 4,797,326 | A | 1/1989 | Csillag |
| 4,811,801 | A | 3/1989 | Salesky et al. |
| 4,871,377 | A | 10/1989 | Frushour |
| 4,913,247 | A | 4/1990 | Jones |
| 4,940,180 | A | 7/1990 | Martell |
| 4,944,772 | A | 7/1990 | Cho |
| 4,985,051 | A | 1/1991 | Ringwood |
| 4,992,082 | A | 2/1991 | Drawl et al. |
| 5,000,273 | A | 3/1991 | Horton et al. |
| 5,011,514 | A | 4/1991 | Cho et al. |
| 5,016,718 | A | 5/1991 | Tandberg |
| 5,032,147 | A | 7/1991 | Frushour |
| 5,049,164 | A | 9/1991 | Horton et al. |
| 5,057,124 | A | 10/1991 | Cerceau |
| 5,092,687 | A | 3/1992 | Hall |
| 5,116,568 | A | 5/1992 | Sung et al. |
| 5,120,327 | A | 6/1992 | Dennis |
| 5,127,923 | A | 7/1992 | Bunting et al. |
| 5,135,061 | A | 8/1992 | Newton, Jr. |
| 5,151,107 | A | 9/1992 | Cho et al. |
| 5,154,245 | A | 10/1992 | Walderstrom et al. |
| 5,173,091 | A | 12/1992 | Marek |
| 5,180,022 | A | 1/1993 | Brady |
| 5,217,154 | A | 6/1993 | Elwood et al. |
| 5,304,342 | A | 4/1994 | Hall et al. |
| 5,326,380 | A | 7/1994 | Yao et al. |
| 5,348,109 | A | 9/1994 | Griffin et al. |
| 5,355,969 | A | 10/1994 | Hardy et al. |
| 5,364,192 | A | 11/1994 | Damm et al. |
| 5,368,398 | A | 11/1994 | Damm et al. |
| 5,370,195 | A | 12/1994 | Keshavan et al. |
| 5,460,233 | A | 10/1995 | Meany et al. |
| 5,480,233 | A | 1/1996 | Cunningham |
| 5,544,713 | A | 8/1996 | Dennis |
| 5,617,997 | A | 4/1997 | Kobayashi et al. |
| 5,645,617 | A | 7/1997 | Frushour |
| 5,660,075 | A | 8/1997 | Johnson et al. |
| 5,722,499 | A | 3/1998 | Nguyen et al. |
| 5,740,874 | A | 4/1998 | Matthias |
| 5,819,862 | A | 10/1998 | Matthias et al. |
| 5,876,859 | A | 3/1999 | Saxelby, Jr. et al. |
| 5,954,147 | A | 9/1999 | Overstreet et al. |
| 5,976,707 | A | 11/1999 | Grab |
| 6,054,693 | A | 4/2000 | Barmatz et al. |
| 6,165,616 | A | 12/2000 | Lemelson et al. |
| 6,196,340 | B1 | 3/2001 | Jensen et al. |
| 6,202,770 | B1 | 3/2001 | Jurewicz et al. |
| 6,202,772 | B1 | 3/2001 | Eyre et al. |
| 6,209,429 | B1 | 4/2001 | Urso, III et al. |
| 6,220,375 | B1 | 4/2001 | Butcher et al. |
| 6,258,139 | B1 | 7/2001 | Jensen |
| 6,270,548 | B1 | 8/2001 | Campbell et al. |
| 6,272,753 | B2 | 8/2001 | Packer |
| 6,302,225 | B1 | 10/2001 | Yoshida et al. |
| 6,338,754 | B1 | 1/2002 | Cannon et al. |
| 6,344,149 | B1 | 2/2002 | Oles |
| 6,390,181 | B1 | 5/2002 | Hall et al. |
| 6,405,814 | B1 | 6/2002 | Eyre et al. |
| 6,410,085 | B1 | 6/2002 | Griffin et al. |
| 6,435,058 | B1 | 8/2002 | Matthias et al. |
| 6,481,511 | B2 | 11/2002 | Matthias et al. |
| 6,544,308 | B2 | 4/2003 | Griffin et al. |
| 6,562,462 | B2 | 5/2003 | Griffin et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,662 | B2 | 8/2003 | Matthias et al. |
| 6,739,214 | B2 | 5/2004 | Griffin et al. |
| 6,749,033 | B2 | 6/2004 | Griffin et al. |
| 6,793,681 | B1 | 9/2004 | Pope et al. |
| 6,797,326 | B2 | 9/2004 | Griffin et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,892,836 | B1 | 5/2005 | Eyre et al. |
| 6,991,049 | B2 | 1/2006 | Eyre et al. |
| 7,060,641 | B2 | 6/2006 | Qian et al. |
| 7,377,341 | B2 | 5/2008 | Middlemiss et al. |
| 7,384,821 | B2 | 6/2008 | Sung |
| 7,473,287 | B2 | 1/2009 | Belnap et al. |
| 7,516,804 | B2 | 4/2009 | Vail |
| 7,552,782 | B1 | 6/2009 | Sexton et al. |
| 7,559,695 | B2 | 7/2009 | Sexton et al. |
| 7,559,965 | B2 | 7/2009 | Oh |
| 7,569,176 | B2 | 8/2009 | Pope et al. |
| 7,608,333 | B2 | 10/2009 | Eyre et al. |
| 7,635,035 | B1 | 12/2009 | Bertagnolli et al. |
| 7,647,933 | B2 | 1/2010 | Middlemiss |
| 7,694,757 | B2 | 4/2010 | Keshavan et al. |
| 7,726,421 | B2 | 6/2010 | Middlemiss |
| 7,740,673 | B2 | 6/2010 | Eyre et al. |
| 7,753,143 | B1 | 7/2010 | Miess et al. |
| 7,754,333 | B2 | 7/2010 | Eyre et al. |
| 7,828,088 | B2 | 11/2010 | Middlemiss et al. |
| 7,841,428 | B2 | 11/2010 | Bertagnolli |
| 7,845,438 | B1 | 12/2010 | Vail et al. |
| 7,866,418 | B2 | 1/2011 | Bertagnolli et al. |
| 7,942,219 | B2 | 3/2011 | Keshavan et al. |
| 7,980,334 | B2 | 7/2011 | Voronin et al. |
| 8,002,859 | B2 | 8/2011 | Griffo et al. |
| 8,028,771 | B2 | 10/2011 | Keshavan et al. |
| 8,034,136 | B2 | 10/2011 | Sani |
| 8,056,650 | B2 | 11/2011 | Middlemiss et al. |
| 8,066,087 | B2 | 11/2011 | Griffo et al. |
| 8,069,937 | B2 | 12/2011 | Mukhopadhyay |
| 8,071,173 | B1 | 12/2011 | Sani |
| 8,080,071 | B1 | 12/2011 | Vail et al. |
| 8,080,074 | B2 | 12/2011 | Sani |
| 8,147,572 | B2 | 4/2012 | Eyre et al. |
| 8,202,335 | B2 | 6/2012 | Cooley et al. |
| 8,236,074 | B1 | 8/2012 | Bertagnolli |
| 8,297,382 | B2 | 10/2012 | Bertagnolli et al. |
| 8,323,367 | B1 | 12/2012 | Bertagnolli |
| 8,328,891 | B2 | 12/2012 | Zhang et al. |
| 8,353,371 | B2 | 1/2013 | Cooley et al. |

(56) References Cited

U.S. PATENT DOCUMENTS

| | | | |
|---|---|---|---|
| 8,415,033 | B2 | 4/2013 | Matsuzawa et al. |
| 8,529,649 | B2 | 9/2013 | Sani |
| 8,616,306 | B2 | 12/2013 | Bertagnolli et al. |
| 8,784,517 | B1 | 7/2014 | Gonzalez et al. |
| 8,911,521 | B1 | 12/2014 | Miess et al. |
| 8,979,956 | B2 | 3/2015 | Sani |
| 2001/0004946 | A1 | 6/2001 | Jensen |
| 2001/0040053 | A1 | 11/2001 | Beuershausen |
| 2002/0029909 | A1 | 3/2002 | Griffo et al. |
| 2002/0079140 | A1 | 6/2002 | Eyre et al. |
| 2003/0019333 | A1 | 1/2003 | Scott |
| 2003/0037964 | A1 | 2/2003 | Sinor et al. |
| 2003/0079918 | A1 | 3/2003 | Eyre et al. |
| 2003/0191533 | A1 | 10/2003 | Dixon et al. |
| 2004/0111159 | A1 | 6/2004 | Pope et al. |
| 2004/0112650 | A1 | 6/2004 | Moseley |
| 2004/0155096 | A1 | 8/2004 | Zimmerman et al. |
| 2005/0044800 | A1 | 3/2005 | Hall et al. |
| 2005/0050801 | A1 | 3/2005 | Cho et al. |
| 2005/0117984 | A1 | 6/2005 | Eason |
| 2005/0189443 | A1 | 9/2005 | Taylor et al. |
| 2005/0210755 | A1 | 9/2005 | Cho et al. |
| 2005/0211475 | A1 | 9/2005 | Mirchandani et al. |
| 2005/0247492 | A1 | 11/2005 | Shen et al. |
| 2006/0042172 | A1 | 3/2006 | Sung |
| 2006/0054363 | A1 | 3/2006 | Eyre et al. |
| 2006/0060391 | A1 | 3/2006 | Eyre et al. |
| 2006/0060392 | A1 | 3/2006 | Eyre |
| 2006/0157884 | A1 | 7/2006 | Ludtke et al. |
| 2006/0165993 | A1 | 7/2006 | Keshavan |
| 2006/0180354 | A1 | 8/2006 | Belnap et al. |
| 2006/0207802 | A1 | 9/2006 | Zhang et al. |
| 2006/0254830 | A1 | 11/2006 | Radtke |
| 2006/0263233 | A1 | 11/2006 | Gardinier |
| 2006/0266558 | A1 | 11/2006 | Middlemiss et al. |
| 2006/0266559 | A1 | 11/2006 | Keshavan et al. |
| 2007/0023206 | A1 | 2/2007 | Keshavan et al. |
| 2007/0034416 | A1 | 2/2007 | Cho et al. |
| 2007/0056778 | A1 | 3/2007 | Webb et al. |
| 2007/0079994 | A1 | 4/2007 | Middlemiss |
| 2007/0102202 | A1 | 5/2007 | Choe et al. |
| 2007/0187155 | A1 | 8/2007 | Middlemiss |
| 2008/0019098 | A1 | 1/2008 | Sung |
| 2008/0099250 | A1 | 5/2008 | Hall et al. |
| 2008/0206576 | A1 | 8/2008 | Qian et al. |
| 2008/0223575 | A1 | 9/2008 | Oldham et al. |
| 2008/0223621 | A1 | 9/2008 | Middlemiss et al. |
| 2008/0223623 | A1 | 9/2008 | Keshavan et al. |
| 2008/0230279 | A1 | 9/2008 | Bitler et al. |
| 2008/0230280 | A1 | 9/2008 | Keshavan et al. |
| 2008/0247899 | A1 | 10/2008 | Cho et al. |
| 2009/0120009 | A1 | 5/2009 | Sung |
| 2009/0152015 | A1 | 6/2009 | Sani et al. |
| 2009/0166094 | A1 | 7/2009 | Keshavan et al. |
| 2009/0173015 | A1 | 7/2009 | Keshavan et al. |
| 2009/0173547 | A1 | 7/2009 | Voronin et al. |
| 2009/0313908 | A1 | 12/2009 | Zhang et al. |
| 2010/0012389 | A1 | 1/2010 | Zhang et al. |
| 2010/0038148 | A1 | 2/2010 | King |
| 2010/0095602 | A1* | 4/2010 | Belnap ..... C04B 35/52 51/309 |
| 2010/0104874 | A1 | 4/2010 | Yong et al. |
| 2010/0122852 | A1 | 5/2010 | Russell et al. |
| 2010/0155149 | A1 | 6/2010 | Keshavan et al. |
| 2010/0181117 | A1 | 7/2010 | Scott |
| 2010/0186303 | A1 | 7/2010 | Ras et al. |
| 2010/0196717 | A1 | 8/2010 | Liversage et al. |
| 2010/0212971 | A1 | 8/2010 | Mukhopadhyay |
| 2010/0236836 | A1 | 9/2010 | Voronin |
| 2010/0243336 | A1 | 9/2010 | Dourfaye et al. |
| 2010/0281782 | A1 | 11/2010 | Keshavan et al. |
| 2010/0287845 | A1 | 11/2010 | Montross et al. |
| 2010/0294571 | A1* | 11/2010 | Belnap et al. ..... 51/307 |
| 2011/0023375 | A1 | 2/2011 | Sani et al. |
| 2011/0031031 | A1 | 2/2011 | Vemptai et al. |
| 2011/0036643 | A1 | 2/2011 | Belnap et al. |
| 2011/0042149 | A1* | 2/2011 | Scott et al. ..... 51/309 |
| 2011/0056753 | A1 | 3/2011 | Middlemiss et al. |
| 2011/0067929 | A1 | 3/2011 | Mukhopadhyay et al. |
| 2011/0083908 | A1 | 4/2011 | Shen et al. |
| 2011/0088950 | A1* | 4/2011 | Scott ..... C23C 30/005 51/307 |
| 2011/0120782 | A1 | 5/2011 | Cooley et al. |
| 2011/0259648 | A1 | 10/2011 | Sani |
| 2011/0283628 | A1 | 11/2011 | Saridikmen et al. |
| 2011/0284294 | A1 | 11/2011 | Cox et al. |
| 2012/0037429 | A1 | 2/2012 | Davies et al. |
| 2012/0047815 | A1 | 3/2012 | Sani |
| 2012/0080239 | A1 | 4/2012 | Lyons et al. |
| 2012/0103701 | A1 | 5/2012 | Cho et al. |
| 2012/0138370 | A1 | 6/2012 | Mukhopadhyay et al. |
| 2012/0228037 | A1 | 9/2012 | Cooley et al. |
| 2012/0241224 | A1 | 9/2012 | Qian et al. |
| 2013/0205677 | A1 | 8/2013 | Bertagnolli et al. |
| 2013/0291443 | A1 | 11/2013 | Naidoo et al. |
| 2013/0313027 | A1 | 11/2013 | Sani |
| 2014/0223835 | A1 | 8/2014 | Thigpen et al. |
| 2014/0283457 | A1 | 9/2014 | Cariveau et al. |
| 2015/0114726 | A1 | 4/2015 | Shen et al. |

FOREIGN PATENT DOCUMENTS

| | | |
|---|---|---|
| EP | 0 374 424 | 6/1990 |
| EP | 0 699 642 | 3/1996 |
| EP | 2572011 | 3/2013 |
| GB | 2300424 | 11/1996 |
| GB | 2 461 198 | 12/2009 |
| JP | S59219500 | 12/1984 |
| WO | WO 08/063568 | 5/2008 |
| WO | 2009/125355 | 10/2009 |
| WO | WO 2010/039346 | 4/2010 |
| WO | WO 2010/098978 | 9/2010 |
| WO | WO 2010/100629 | 9/2010 |
| WO | WO 2010/100630 | 9/2010 |

OTHER PUBLICATIONS

U.S. Appl. No. 13/100,388, Jun. 17, 2014, Notice of Allowance.
U.S. Appl. No. 13/027,954, Jun. 3, 2014, Notice of Allowance.
U.S. Appl. No. 13/917,952, Jun. 11, 2014, Issue Notification.
U.S. Appl. No. 13/397,971, Jun. 19, 2014, Office Action.
U.S. Appl. No. 13/953,453, Jun. 24, 2014, Notice of Allowance.
U.S. Appl. No. 14/327,264, filed Jul. 9, 2014, Sani.
U.S. Appl. No. 14/330,851, filed Jul. 14, 2014, Sani.
U.S. Appl. No. 14/495,759, filed Sep. 24, 2014, Sani.
U.S. Appl. No. 14/504,253, filed Oct. 1, 2014, Bertagnolli et al.
U.S. Appl. No. 12/548,584, Jun. 25, 2014, Issue Notification.
U.S. Appl. No. 13/032,350, Aug. 13, 2014, Issue Notification.
U.S. Appl. No. 13/100,388, Aug. 4, 2014, Notice of Allowance.
U.S. Appl. No. 13/285,198, Jul. 30, 2014, Issue Notification.
U.S. Appl. No. 13/292,491, Aug. 8, 2014, Office Action.
U.S. Appl. No. 13/027,954, Sep. 12, 2014, Notice of Allowance.
U.S. Appl. No. 13/690,397, Jul. 9, 2014, Issue Notification.
U.S. Appl. No. 13/323,138, Jul. 29, 2014, Notice of Allowance.
U.S. Appl. No. 14/512,007, filed Oct. 10, 2014, Bertagnolli et al.
U.S. Appl. No. 13/171,735, Aug. 6, 2014, Issue Notification.
U.S. Appl. No. 14/264,932, filed Apr. 29, 2014, Vail.
U.S. Appl. No. 13/171,735, May 7, 2014, Notice of Allowance.
U.S. Appl. No. 13/292,900, May 28, 2014, Issue Notification.
Decker, et al., "High-Pressure Calibration: A Critical Review," J. Phys. Chem. Ref. Data, 1, 3 (1972).
Rousse, et al. "Structure of the Intermediate Phase of PbTe at High Pressure," Physical Review B: Condensed Matter and Materials Physics, 71, 224116 (2005).
U.S. Appl. No. 12/548,584, Mar. 6, 2014, Notice of Allowance.
U.S. Appl. No. 13/032,350, Apr. 15, 2014, Notice of Allowance.
U.S. Appl. No. 13/285,198, Apr. 11, 2014, Notice of Allowance.
U.S. Appl. No. 13/292,491, Mar. 21, 2014, Office Action.
U.S. Appl. No. 13/027,954, Mar. 10, 2014, Office Action.
U.S. Appl. No. 13/690,397, Mar. 12, 2014, Notice of Allowance.

(56) References Cited

OTHER PUBLICATIONS

U.S. Appl. No. 13/917,952, Feb. 26, 2014, Notice of Allowance.
U.S. Appl. No. 12/961,787, Apr. 11, 2014, Office Action.
U.S. Appl. No. 13/323,138, Mar. 12, 2014, Notice of Allowance.
U.S. Appl. No. 13/953,453, Mar. 18, 2014, Office Action.
U.S. Appl. No. 60/850,969, filed Oct. 10, 2006, Cooley, et al.
U.S. Appl. No. 60/860,098, filed Nov. 20, 2006, Sani.
U.S. Appl. No. 60/876,701, filed Dec. 21, 2006, Sani.
U.S. Appl. No. 61/068,120, filed Mar. 3, 2008, Vail.
U.S. Appl. No. 12/548,584, filed Aug. 27, 2009, Bertagnolli.
U.S. Appl. No. 13/027,954, filed Feb. 15, 2011, Miess et al.
U.S. Appl. No. 13/100,388, filed May 4, 2011, Jones et al.
U.S. Appl. No. 13/171,735, filed Jun. 29, 2011, Bertagnolli.
U.S. Appl. No. 13/285,198, filed Oct. 31, 2011, Sani.
U.S. Appl. No. 13/292,900, filed Nov. 9, 2011, Vail.
U.S. Appl. No. 13/323,138, filed Dec. 12, 2011, Miess et al.
U.S. Appl. No. 13/690,397, filed Nov. 30, 2012, Miess et al.
U.S. Appl. No. 13/397,971, filed Feb. 16, 2012, Miess et al.
U.S. Appl. No. 14/067,831, filed Oct. 30, 2013, Bertagnolli et al.
Akaishi, Minoru, "Synthesis of polycrystalline diamond compact with magnesium carbonate and its physical properties," Diamond and Related Materials, 1996 (pp. 2-7).
Declaration of Prior Sales of Terracut PDCS executed by Kenneth E. Bertagnolli Feb. 3, 2011.
Declaration of Prior Sales of Terracut PDCS executed by Paul D. Jones Feb. 3, 2011.
Ekimov, E.A., et al. "Mechanical Properties and Microstructure of Diamond-SiC Nanocomposites" Inorganic Materials, vol. 38, No. 11, 2002, pp. 1117-1122.
Glowka, D.A. & Stone, C.M., "Effects of Termal and Mechanical Loading on PDC Bit Life", SPE Drilling Engineering, Jun. 1986 (pp. 201-214).
Hosomi, Satoru, et al., "Diamond Formation by a Solid State Reaction", Science and Technology of New Diamond, pp. 239-243 (1990).
Hsueh, C.H. & Evans, A.G., "Residual Stresses in Metal/Ceramic Bonded Strips", J. Am. Ceram. Soc., 68 [5] (1985) pp. 241-248.
International Search Report and Written Opinion for PCT International Application No. PCT/US2007/024090; dated Apr. 15, 2008.
International Search Report and Written Opinion from International Application No. PCT/US2011/060380 dated Mar. 12, 2012.
Ledbetter, H.M., et al. "Elastic Properties of Metals and Alloys. II. Copper", Journal of Physics and Chemical Reference Data, vol. 3, No. 4, 1974. pp. 897-935.
Lin, Tze-Pin; Hood, Michael & Cooper George A., "Residual Stresses in Polycrystalline Diamond Compacts", J. Am. Ceram Soc., 77 [6] (1994) pp. 1562-1568.
Liu, Xueran, et al., "Fabrication of the supersaturated solid solution of carbon in copper by mechanical alloying", Materials Characterization, vol. 58, Issue 8 (Jun. 2007), pp. 504-508.
Orwa, J.O., et al., "Diamond nanocrystals formed by direct implantation of fused silica with carbon," Journal of Applied Physics, vol. 90, No. 6, 2001, pp. 3007-3018.
Radtke, Robert, "Faster Drilling, Longer Life: Thermally Stable Diamond Drill Bit Cutters," Drilling Systems, Summer 2004 (pp. 5-9).
Saji, S., et al., Solid Solubility of Carbon in Copper during Mechanical Alloying, Materials Transactions, vol. 39, No. 7 (1998), pp. 778-781.
Suryanarayana, C., "Novel Methods of BRAZING Dissimilar Materials," Advanced Materials & Processes, Mar. 2001 (3 pgs).
Tanaka, T., et al., "Formation of Metastable Phases of Ni—C and Co—C Systems by Mechanical Alloying", Metallurgical Transactions, vol. 23A, Sep. 1992, pp. 2431-2435.
Timoshenko, S.P. & Goodler, J.N., "Theory of Elasticity", McGraw-Hill Classic Textbook Reissue 1934, pp. 8-11, 456-458.
Tomlinson, P.N. et al. "Syndax3 Pins—New Concepts in PCD Drilling," Rock Drilling, IDR 3/92, 1992 (pp. 109-114).
Ueda, Fumihiro, "Cutting performance of sintered diamond with MgCO3 as a sintering agent," Materials Science and Engineering, 1996 (pp. 260-263).
Yamane, T., et al., "Solid solubility of carbon in copper mechanically alloyed", Journal of Materials Science Letters 20 (2001), pp. 259-260.
U.S. Appl. No. 11/983,619, May 26, 2010, Office Action.
U.S. Appl. No. 11/545,929, Aug. 13, 2008, Office Action.
U.S. Appl. No. 11/545,929, Jan. 21, 2009, Office Action.
U.S. Appl. No. 11/545,929, Aug. 27, 2009, Office Action.
U.S. Appl. No. 11/545,929, Apr. 15, 2010, Office Action.
U.S. Appl. No. 11/545,929, Jul. 21, 2010, Office Action.
U.S. Appl. No. 11/545,929, Mar. 20, 2012, Notice of Allowance.
U.S. Appl. No. 11/545,929, Jul. 18, 2012, Issue Notification.
U.S. Appl. No. 11/983,619, Aug. 9, 2010, Office Action.
U.S. Appl. No. 11/983,619, Mar. 28, 2011, Office Action.
U.S. Appl. No. 11/983,619, Jun. 16, 2011, Notice of Allowance.
U.S. Appl. No. 11/983,619, Sep. 21, 2011, Issue Notification.
U.S. Appl. No. 12/271,081, Dec. 22, 2010, Office Action.
U.S. Appl. No. 12/271,081, Mar. 31, 2011, Office Action.
U.S. Appl. No. 12/271,081, Aug. 8, 2011, Office Action.
U.S. Appl. No. 12/271,081, Oct. 5, 2011, Notice of Allowance.
U.S. Appl. No. 12/363,104, Oct. 14, 2010, Office Action.
U.S. Appl. No. 12/363,104, Apr. 12, 2011, Office Action.
U.S. Appl. No. 12/363,104, Aug. 25, 2011, Notice of Allowance.
U.S. Appl. No. 12/394,356, Sep. 1, 2011, Notice of Allowance.
U.S. Appl. No. 12/394,356, Nov. 30, 2011, Issue Notification.
U.S. Appl. No. 12/397,969, May 25, 2012, Notice of Allowance.
U.S. Appl. No. 12/397,969, Nov. 14, 2012, Issue Notification.
U.S. Appl. No. 12/548,584, May 18, 2012, Office Action.
U.S. Appl. No. 12/548,584, Oct. 24, 2012, Office Action.
U.S. Appl. No. 12/548,584, Jan. 3, 2013, Office Action.
U.S. Appl. No. 12/548,584, Jun. 14, 2013, Office Action.
U.S. Appl. No. 12/548,584, Sep. 26, 2013, Office Action.
U.S. Appl. No. 13/032,350, Nov. 26, 2012, Office Action.
U.S. Appl. No. 13/032,350, Mar. 14, 2013, Office Action.
U.S. Appl. No. 13/032,350, Sep. 30, 2013, Office Action.
U.S. Appl. No. 13/100,388, Oct. 18, 2013, Office Action.
U.S. Appl. No. 13/100,388, Jan. 15, 2014, Office Action.
U.S. Appl. No. 13/171,735, Aug. 17, 2012, Office Action.
U.S. Appl. No. 13/171,735, Jan. 24, 2013, Office Action.
U.S. Appl. No. 13/171,735, Jul. 12, 2013, Office Action.
U.S. Appl. No. 13/171,735, Jan. 10, 2014, Office Action.
U.S. Appl. No. 13/230,125, May 23, 2012, Office Action.
U.S. Appl. No. 13/230,125, Jul. 11, 2012, Office Action.
U.S. Appl. No. 13/230,125, Jan. 18, 2013, Office Action.
U.S. Appl. No. 13/230,125, May 1, 2013, Notice of Allowance.
U.S. Appl. No. 13/230,125, Aug. 21, 2013, Issue Notification.
U.S. Appl. No. 13/285,198, Apr. 3, 2012, Office Action.
U.S. Appl. No. 13/285,198, Jul. 11, 2012, Office Action.
U.S. Appl. No. 13/285,198, Feb. 5, 2013, Notice of Allowance.
U.S. Appl. No. 13/285,198, Jul. 22, 2013, Notice of Allowance.
U.S. Appl. No. 13/285,198, Nov. 22, 2013, Notice of Allowance.
U.S. Appl. No. 13/292,491, Aug. 8, 2012, Office Action.
U.S. Appl. No. 13/292,491, Feb. 11, 2013, Office Action.
U.S. Appl. No. 13/292,491, Jul. 18, 2013, Office Action.
U.S. Appl. No. 13/292,491, Oct. 29, 2013, Office Action.
U.S. Appl. No. 13/027,954, Jul. 18, 2013, Office Action.
U.S. Appl. No. 13/027,954, Nov. 13, 2013, Office Action.
U.S. Appl. No. 13/690,397, Feb. 14, 2013, Office Action.
U.S. Appl. No. 13/690,397, May 29, 2013, Notice of Allowance.
U.S. Appl. No. 13/690,397, Aug. 9, 2013, Office Action.
U.S. Appl. No. 13/690,397, Nov. 25, 2013, Office Action.
U.S. Appl. No. 13/917,952, Jul. 31, 2013, Office Action.
U.S. Appl. No. 13/917,952, Nov. 13, 2013, Office Action.
U.S. Appl. No. 13/292,900, May 23, 2013, Office Action.
U.S. Appl. No. 13/292,900, Oct. 22, 2013, Notice of Allowance.
U.S. Appl. No. 13/292,900, Nov. 25, 2013, Notice of Allowance.
U.S. Appl. No. 13/292,900, Jan. 30, 2014, Notice of Allowance.
U.S. Appl. No. 12/961,787, May 29, 2013, Office Action.
U.S. Appl. No. 12/961,787, Aug. 30, 2013, Office Action.
U.S. Appl. No. 13/323,138, Oct. 1, 2013, Office Action.
U.S. Appl. No. 13/323,138, Nov. 29, 2013, Notice of Allowance.

(56) References Cited

OTHER PUBLICATIONS

U.S. Appl. No. 13/953,453, Sep. 19, 2013, Office Action.
U.S. Appl. No. 13/953,453, Oct. 10, 2013, Office Action.
U.S. Appl. No. 12/961,787, Dec. 3, 2015, Office Action.
U.S. Appl. No. 14/570,506, Sep. 15, 2015, Office Action.
U.S. Appl. No. 14/067,831, Jul. 15, 2015, Office Action.
U.S. Appl. No. 14/067,831, Oct. 26, 2015, Office Action.
U.S. Appl. No. 14/297,359, Oct. 30, 2015, Notice of Allowance.
U.S. Appl. No. 14/327,264, Nov. 6, 2015, Office Action.
U.S. Appl. No. 14/330,851, Nov. 12, 2015, Office Action.
Clegg et al., "Faster, Longer, and More-Reliable Bit Runs With New-Generation PDC Cutter" SPE 102067, pp. 1-9, 2006.
U.S. Appl. No. 12/961,787, Jun. 17, 2016, Non-Final Office Action.
U.S. Appl. No. 14/570,506, Dec. 16, 2015, Interview Summary.
U.S. Appl. No. 14/570,506, Mar. 1, 2016, Non-Final Office Action.
U.S. Appl. No. 14/570,506, May 25, 2016, Interview Summary.
U.S. Appl. No. 14/570,506, Aug. 10, 2016, Notice of Allowance.
U.S. Appl. No. 14/067,831, Apr. 7, 2016, Final Office Action.
U.S. Appl. No. 14/067,831, Aug. 25, 2016, Advisory Action.
U.S. Appl. No. 14/297,359, Mar. 14, 2016, Notice of Allowance.
U.S. Appl. No. 14/297,359, Jun. 15, 2016, Issue Notification.
U.S. Appl. No. 14/327,264, Feb. 2, 2016, Notice of Allowance.
U.S. Appl. No. 14/327,264, May 26, 2016, Notice of Allowance.
U.S. Appl. No. 14/327,264, Jun. 8, 2016, Issue Notification.
U.S. Appl. No. 14/330,851, Jul. 14, 2016, Non-Final Office Action.
U.S. Appl. No. 14/495,759, Jan. 20, 2016, Rrestriction Requirement.
U.S. Appl. No. 14/495,759, May 25, 2016, Non-Final Office Action.
U.S. Appl. No. 14/512,007, Feb. 2, 2016, Non-Final Office Action.
U.S. Appl. No. 14/633,041, Apr. 11, 2016, Non-Final Office Action.
U.S. Appl. No. 14/614,332, Jul. 1, 2016, Non-Final Office Action.
U.S. Appl. No. 14/634,395, Jul. 29, 2016, Non-Final Office Action.
U.S. Appl. No. 14/504,253, Aug. 25, 2016, Non-Final Office Action.
U.S. Appl. No. 14/570,506, Nov. 22, 2016, Notice of Allowance.
U.S. Appl. No. 14/330,851, Dec. 29, 2016, Office Action.
U.S. Appl. No. 14/495,759, Oct. 3, 2016, Notice of Allowance.
U.S. Appl. No. 12/961,787, Jan. 17, 2017, Office Action.
U.S. Appl. No. 14/067,831, Jan. 20, 2017, Office Action.
U.S. Appl. No. 14/495,759, Feb. 8, 2017, Notice of Allowance.
U.S. Appl. No. 14/614,332, Jan. 13, 2017, Office Action.
U.S. Appl. No. 14/634,395, Jan. 11, 2017, Notice of Allowance.
U.S. Appl. No. 14/634,395, Jan. 26, 2017, Supplemental Notice of Allowance.
U.S. Appl. No. 14/661,993, Oct. 26, 2016, Restriction Requirement.
U.S. Appl. No. 14/661,993, Feb. 16, 2017, Office Action.
U.S. Appl. No. 14/570,506, filed Dec. 15, 2014, Miess et al.
U.S. Appl. No. 14/614,332, filed Feb. 8, 2015, Bertagnolli et al.
U.S. Appl. No. 14/621,019, filed Feb. 12, 2015, Jones et al.
U.S. Appl. No. 14/633,041, filed Feb. 26, 2015, Miess et al.
U.S. Appl. No. 14/634,395, filed Feb. 27, 2015, Miess et al.
U.S. Appl. No. 14/661,993, filed Mar. 18, 2015, Sani.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
U.S. Appl. No. 13/100,388, Nov. 7, 2014, Notice of Allowance.
U.S. Appl. No. 13/100,388, Dec. 24, 2014, Notice of Allowance.
U.S. Appl. No. 13/100,388, Mar. 4, 2015, Notice of Allowance.
U.S. Appl. No. 13/100,388, Apr. 13, 2015, Notice of Allowance.
U.S. Appl. No. 13/100,388, Apr. 22, 2015, Issue Notiification.
U.S. Appl. No. 13/292,491, Nov. 3, 2014, Office Action.
U.S. Appl. No. 13/292,491, Dec. 19, 2014, Notice of Allowance.
U.S. Appl. No. 13/292,491, Apr. 15, 2015, Issue Notiification.
U.S. Appl. No. 13/027,954, Dec. 26, 2014, Notice of Allowance.
U.S. Appl. No. 13/027,954, Apr. 8, 2015, Issue Notiification.
U.S. Appl. No. 12/961,787, May 21, 2015, Office Action.
U.S. Appl. No. 13/323,138, Nov. 25, 2014, Issue Notiification.
U.S. Appl. No. 13/397,971, Nov. 26, 2014, Notice of Allowance.
U.S. Appl. No. 13/397,971, Mar. 19, 2015, Issue Notiification.
U.S. Appl. No. 13/953,453, Feb. 12, 2015, Notice of Allowance.
U.S. Appl. No. 13/953,453, Feb. 25, 2015, Issue Notiification.
U.S. Appl. No. 12/961,787, Jun. 1, 2017, Advisory Action.
U.S. Appl. No. 14/570,506, Mar. 17, 2017, Corrected Notice of Allowance.
U.S. Appl. No. 14/570,506, Mar. 29, 2017, Issue Notification.
U.S. Appl. No. 14/067,831, Jun. 14, 2017, Office Action.
U.S. Appl. No. 14/330,851, Aug. 10, 2017, Office Action.
U.S. Appl. No. 14/495,759, May 10, 2017, Issue Notification.
U.S. Appl. No. 14/614,332, Aug. 15, 2017, Office Action.
U.S. Appl. No. 14/634,395, Apr. 19, 2017, Issue Notification.
U.S. Appl. No. 14/661,993, Jun. 21, 2017, Notice of Allowance.
U.S. Appl. No. 14/621,019, Mar. 30, 2017, Restriction Requirement.
U.S. Appl. No. 14/621,019, May 19, 2017, Office Action.
U.S. Appl. No. 12/961,787, Oct. 5, 2017, Office Action.
U.S. Appl. No. 14/067,831, Dec. 19, 2017, Notice of Allowance.
U.S. Appl. No. 14/614,332, Jan. 18, 2018, Office Action.
U.S. Appl. No. 14/661,993, Oct. 18, 2017, Issue Notification.
U.S. Appl. No. 14/621,019, Dec. 26, 2017, Office Action.
U.S. Appl. No. 12/967,787, dated Apr. 26, 2018 Office Action.
U.S. Appl. No. 12/961,787, dated Sep. 28, 2018 Notice of Allowance.
U.S. Appl. No. 14/067,831, Apr. 4, 2018 Issue Notification.
U.S. Appl. No. 14/614,332, June 6, 2018 Office Action.
U.S. Appl. No. 14/621,019, dated Aug. 10, 2018 Notice of Allowance.
U.S. Appl. No. 14/621,019, dated Nov. 28, 2018 Issue Notification.
U.S. Appl. No. 12/961,787, dated Jan. 14, 2019 Notice of Allowance.
U.S. Appl. No. 14/614,332, dated Jan. 25, 2019 Office Action.

* cited by examiner

POLYCRYSTALLINE DIAMOND COMPACTS

CROSS-REFERENCE TO RELATED APPLICATIONS

This application is a continuation of U.S. application Ser. No. 12/961,787 filed on 7 Dec. 2010, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container or cartridge with a volume of diamond particles positioned on a surface of the cemented carbide substrate. A number of such cartridges may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

The presence of the solvent catalyst in the PCD table is believed to reduce the thermal stability of the PCD table at elevated temperatures. For example, the difference in thermal expansion coefficient between the diamond grains and the solvent catalyst is believed to lead to chipping or cracking of the PCD table during drilling or cutting operations, which consequently can degrade the mechanical properties of the PCD table or cause failure. Additionally, some of the diamond grains can undergo a chemical breakdown or back-conversion to graphite via interaction with the solvent catalyst. At elevated high temperatures, portions of the diamond grains may transform to carbon monoxide, carbon dioxide, graphite, or combinations thereof, causing degradation of the mechanical properties of the PCD table.

One conventional approach for improving the thermal stability of PDCs is to at least partially remove the solvent catalyst from the PCD table of the PDC by acid leaching.

In another conventional approach for forming a PDC, a sintered PCD table may be separately formed and then leached to remove the solvent catalyst from interstitial regions between bonded diamond grains. The leached PCD table may be simultaneously HPHT bonded to a cemented carbide substrate and infiltrated with silicon and cobalt from the substrate in a separate HPHT process. The silicon may infiltrate the interstitial regions of the leached PCD table from which the solvent catalyst has been leached and react with the diamond grains to form silicon carbide. The cobalt may also infiltrate the interstitial regions of the leached PCD table from which the solvent catalyst has been leached to form a bond with the cemented carbide substrate. PDCs sold under the trade name Terracut were fabricated by the foregoing process.

Despite the availability of a number of different PDCs, manufacturers and users of PDCs continue to seek PDCs that exhibit improved toughness, wear resistance, thermal stability, or combinations thereof.

SUMMARY

Embodiments of the invention relate to methods of manufacturing PDCs by infiltrating an at least partially leached PCD table in a controlled manner in an HPHT process, and resultant PDCs. The temperature, pressure, and HPHT process time are chosen to control a depth to which an infiltrant partially infiltrates into the at least partially leached PCD table in the HPHT process.

In an embodiment, a method of fabricating a PDC includes forming a PCD table in the presence of a metal-solvent catalyst in a first HPHT process. The PCD table so formed includes a plurality of bonded diamond grains defining a plurality of interstitial regions, with at least a portion of the plurality of interstitial regions including the metal-solvent catalyst disposed therein. The plurality of bonded diamond grains exhibits an average grain size of about 40 μm or less. The method further includes at least partially leaching the PCD table to remove at least a portion of the metal-solvent catalyst therefrom. The method additionally includes subjecting the at least partially leached PCD table and a substrate to a second HPHT process under diamond-stable temperature-pressure conditions to partially infiltrate the at least partially leached PCD table with an infiltrant and attach the partially infiltrated PCD table to the substrate. A maximum temperature (T), a total process time (t), and a maximum internal cell pressure (P) of the second HPHT process are chosen so that 0 is about 2 to about 325° Celsius·hours/gigapascals ("° C.·h/GPa"), with β represented as $\beta=T\cdot t/P$. The infiltrated polycrystalline diamond table includes a first region adjacent to the substrate including the infiltrant disposed in at least a portion of the interstitial regions thereof and a second region extending inwardly from an exterior working surface to a selected depth of at least about 700 μm. The second region is substantially free of the infiltrant.

In an embodiment, a PDC includes a substrate, and a pre-sintered PCD table bonded to the substrate. The pre-sintered PCD table includes an exterior working surface, at least one lateral surface, and a chamfer extending between the exterior working surface and the at least one lateral surface. The pre-sintered PCD table includes a plurality of bonded diamond grains defining a plurality of interstitial regions. The plurality of bonded diamond grains exhibits an average grain size of about 40 μm or less. The pre-sintered PCD table further includes a first region and a second region. The first region is adjacent to the substrate, and at least a portion of the interstitial regions of the first region include an infiltrant disposed therein. The second region is adjacent to the first region and extends inwardly from the exterior working surface to a selected depth of at least about 700 μm. The interstitial regions of the second region are substantially free of the infiltrant. A nonplanar interface is located between the first and second regions.

Other embodiments include applications utilizing the disclosed PDCs in various articles and apparatuses, such as, rotary drill bits, bearing apparatuses, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to methods of manufacturing PDCs by infiltrating an at least partially leached PCD table in a controlled manner in an HPHT process, and resultant PDCs. The temperature, pressure, and HPHT process time are chosen to control a depth to which an infiltrant partially infiltrates into the at least partially leached PCD table in the HPHT process. The disclosed PDCs may be used in a variety of applications, such as rotary drill bits, machining equipment, and other articles and apparatuses.

Figure 1:
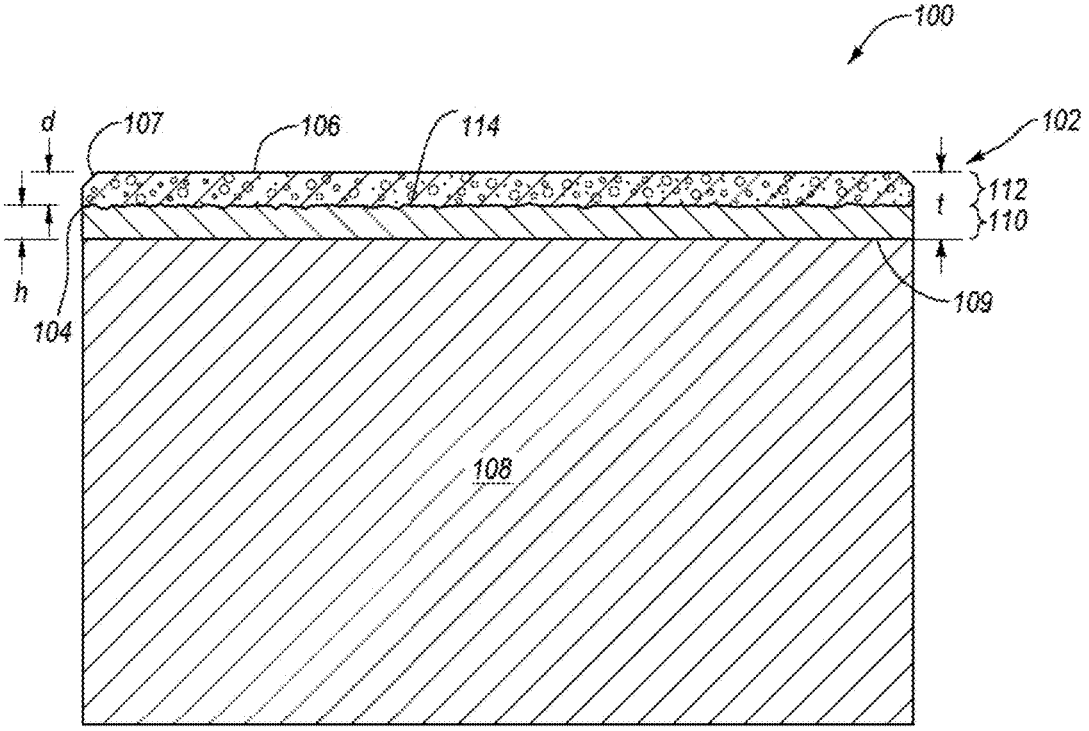
FIG. 1 is a cross-sectional view of an embodiment of a PDC including a partially infiltrated PCD table attached to a cemented carbide substrate.

FIG. 1 is a cross-sectional view of an embodiment of a PDC 100 including a partially infiltrated pre-sintered PCD table 102 attached to a cemented carbide substrate 108 along an interfacial surface 109 thereof. The PCD table 102 includes a plurality of directly bonded-together diamond grains exhibiting diamond-to-diamond bonding (e.g., $sp^3$ bonding) therebetween, which define a plurality of interstitial regions. The PCD table 102 includes at least one lateral surface 104, an upper exterior working surface 106, and an optional chamfer 107 extending therebetween. It is noted that at least a portion of the at least one lateral surface 104 and/or the chamfer 107 may also function as a working surface that contacts a subterranean formation during drilling operations. Additionally, although the interfacial surface 109 is illustrated as being substantially planar, in other embodiments, the interfacial surface 109 may exhibit a selected nonplanar topography, with the PCD table 102 exhibiting a correspondingly configured nonplanar interfacing topography.

The diamond grains of the PCD table 102 may exhibit an average grain size of about 40 μm or less, such as about 30 μm or less, about 25 μm or less, or about 20 μm or less. For example, the average grain size of the diamond grains may be about 10 μm to about 18 μm, about 8 μm to about 15 μm, about 9 μm to about 12 μm, or about 15 μm to about 18 μm. In some embodiments, the average grain size of the diamond grains may be about 10 μm or less, such as about 2 μm to about 5 μm or submicron. The diamond grain size distribution of the diamond grains may exhibit a single mode, or may be a bimodal or greater grain size distribution.

The PCD table 102 exhibits a thickness "t" of at least about 0.040 inch, such as about 0.045 inch to about 0.100 inch, about 0.050 inch to about 0.090 inch, about 0.065 inch to about 0.080 inch, or about 0.070 inch to about 0.080 inch. The infiltrated polycrystalline diamond table 102 includes a first region 110 adjacent to the substrate 108 that extends from the interfacial surface 109 an average selected infiltration distance "h" and includes an infiltrant disposed in at least a portion of the interstitial regions thereof. The infiltrant may be chosen from iron, nickel, cobalt, and alloys of the foregoing metals. For example, the infiltrant may be provided from the substrate 108 (e.g., a cobalt from a cobalt-cemented carbide substrate) or provided from another source such as a metallic foil and/or powder. The PCD table 102 includes a second region 112 that extends inwardly from the working surface 106 to an average selected depth "d." The depth "d" may be at least about 700 μm, about 700 μm to about 2100 μm, about 750 μm to about 2100 μm, about 750 μm to about 1500 μm, about 1000 μm to about 1750 μm, about 1000 μm to about 2000 μm, about 1500 μm to about 2000 μm, about a third of the thickness of the PCD table 102, about half of the thickness of the PCD table 102, or about more than half of the thickness of the PCD table 102. The interstitial regions of the second region 112 are substantially free of the infiltrant.

As the PCD table 102 was fabricated from an at least partially leached PCD table that was subsequently partially infiltrated with the infiltrant, the second region 112 may still include some residual metal-solvent catalyst used to initially form the diamond-to-diamond bonds in the PCD table 112 that was not removed in the leaching process. For example, the residual metal-solvent catalyst in the interstitial regions of the second region 112 may be about 0.5% to about 2% by weight, such as about 0.9% to about 1% by weight. Even with the residual amount of the metal-solvent catalyst in the second region 112, the interstitial regions of the second region 112 may be considered to be substantially void of material.

The substrate 108 comprises a plurality of tungsten carbide or other carbide grains (e.g., tantalum carbide, vanadium carbide, niobium carbide, chromium carbide, and/or titanium carbide) cemented together with a metallic cementing constituent, such as cobalt, iron, nickel, or alloys thereof. For example, in an embodiment, the cemented carbide substrate is a cobalt-cemented tungsten carbide substrate. In some embodiments, the substrate 108 may include two or more different carbides (e.g., tungsten carbide and titanium carbide).

The inventors currently believe that the infiltration depth "h" is primarily governed by capillary action, which depends heavily on the viscosity, surface energy, and contact angle of the infiltrant (e.g., cobalt), as well as the time period over which the HPHT conditions are maintained. For example, according to one theory, the infiltration depth "h" is approximated by the mathematical expression below:

$$h = \frac{2}{\pi}\left[rt\gamma\frac{\mathrm{Cos}\vartheta}{2\upsilon}\right]^{\frac{1}{2}}$$

where:

h=infiltration depth;

r=radius of the interstitial regions of the PCD table 102;

t=time;

θ=contact angle of the infiltrant with the at least partially leached PCD table 102;

γ=surface energy of the infiltrant; and

ν=viscosity (which depends on temperature and pressure) of the infiltrant.

According to one theory, the porosity of the PCD table 102 draws the infiltrant further into the PCD table 102 as a result of capillary action. The infiltration depth "h" is not simply a function of pressure, as increased pressure would be expected to drive more complete penetration of the infiltrant through the PCD table 102. Rather, as shown by working examples 1-4 below, infiltration depth "h" appears to be governed by capillary action so that at a given pressure for which substantially full infiltration occurs, higher pressures (and the same temperature and HPHT process time) will result in less infiltration. According to one theory, infiltration occurs through capillary action rather than a pressure differential. The viscosity of the infiltrant increases at increased pressures, causing less infiltration to occur than at lower pressures, all else being equal. Viscosity is also affected by temperature, i.e., as temperature increases, viscosity decreases, so that at higher temperatures, increased infiltration results. Infiltration may also be affected by process time. Increased processing times result in increased depth of infiltration.

The temperature, pressure, and time period during the HPHT process used for attachment of the PCD table 102 to the substrate 108 may be controlled so as to provide for a desired infiltration depth "h." Partial infiltration of the PCD table 102 may provide the same or better wear resistance and/or thermal stability characteristics of a leached PCD table integrally formed on a substrate (i.e., a one-step PDC) without actual leaching having to be performed, as the infiltrant does not fully infiltrate to the working surface 106 of the PCD table 102. Examples of such an embodiment are described in working examples 3 and 4, below. In some embodiments, the PCD table 102 may be leached to remove a portion of the infiltrant from the first region 110 to improve the uniformity of infiltrant in the first region 110, thermal stability, wear resistance, or combinations of the foregoing. Examples of such embodiments are described in working examples 5-7, below.

It is noted that an irregular nonplanar interface 114 is present between the first region 110 and the second region 112. One effect of this characteristic is that this nonplanar interface 114 between the first region 110 and the second region 112 differs from an otherwise similarly appearing PDC, but in which a region similar to second region 112 (in that it is substantially void of infiltrant) is formed by leaching, particularly if the PCD table 102 includes a chamfer formed therein. In such instances, the leaching profile advances from the outer surfaces exposed to the leaching acid. For example, leaching typically progresses from the exterior surfaces downward and/or inward so that any chamfer or end exposed to the acid affects the leaching profile. The incomplete infiltration operates by a different mechanism in which infiltration occurs from the "bottom up," so that the presence of the chamfer 107 in the PCD table 102 does not affect the infiltration profile of the infiltrant. Additionally, if the infiltrant had infiltrated the entire PCD table 102 so that the interstitial regions of the second region 112 were also occupied by the infiltrant and subsequently removed in a leaching process to the depth "d," a boundary between the first region 110 and the second region 112 would be indicative of being defined by a leaching process as opposed to being relatively irregular.

As will be discussed in more detail below, the PCD table 102 is formed separately from the substrate 108, and the PCD table 102 is subsequently attached to the substrate 108. For example, in an embodiment, the PCD table 102 may be integrally formed with a first cemented carbide substrate, after which the first substrate is removed, the separated PCD table is at least partially leached, and the at least partially leached PCD table is then attached to the substrate 108 in a second HPHT process. In another embodiment, the PCD table 102 may be formed without using a cemented carbide substrate (e.g., by subjecting diamond particles and a metal-solvent catalyst to a HPHT process), after which the formed PCD table is at least partially leached and attached to the substrate 108.

When attaching the PCD table 102 to substrate 108 in a second HPHT process, the HPHT process conditions (e.g., maximum temperature, maximum pressure, and total process time) are specifically chosen to result in only partial infiltration of the PCD table 102. As a result of this second HPHT process, the infiltrant within the substrate 108 (e.g., cobalt from a cobalt-cemented tungsten carbide) infiltrates from the substrate 108 into at least some of the interstitial regions of PCD table 102 in the first region 110.

Figure 2:
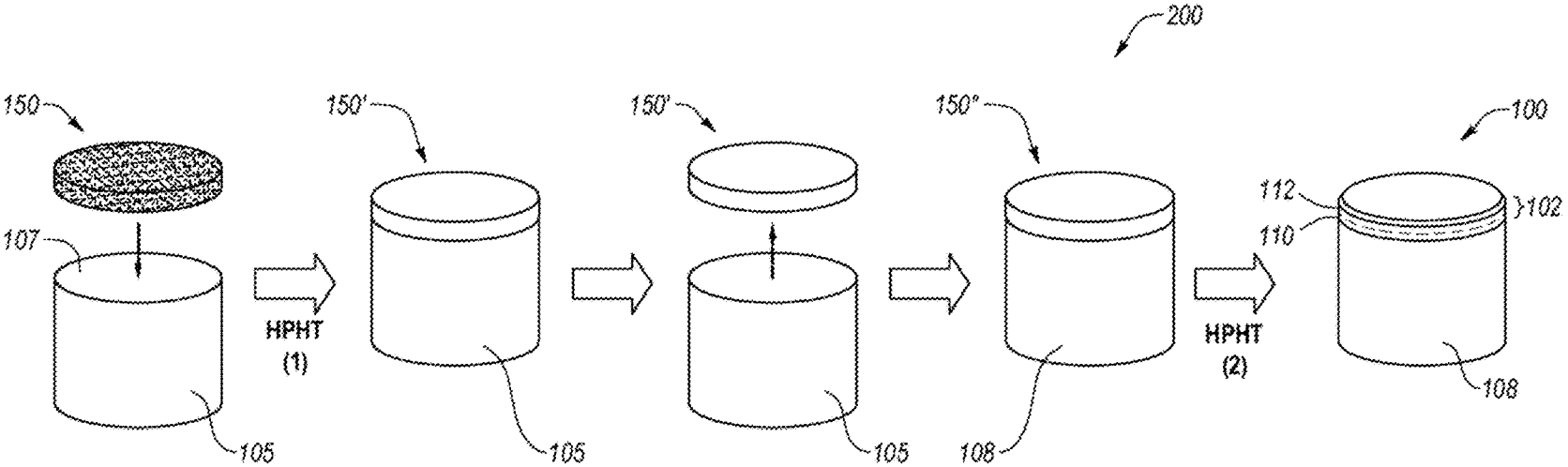
FIG. 2 is a schematic illustration of an embodiment of a method for fabricating the PDC shown in FIG. 1.

FIG. 2 is a schematic illustration of an embodiment of a method for fabricating the PDC 100 shown in FIG. 1. The plurality of diamond particles of the one or more layers of diamond particles 150 may be positioned adjacent to an interfacial surface 107 of a first cemented carbide substrate 105.

In an embodiment, the diamond particles of the one or more layers of diamond particles 150 may exhibit an average particle size of about 40 μm or less, such as about 30 μm or less, about 25 μm or less, or about 20 μm or less. For example, the average particle size of the diamond particles may be about 10 μm to about 18 μm, about 8 μm to about 15 μm, about 9 μm to about 12 μm, or about 15 μm to about 18 μm. In some embodiments, the average particle size of the diamond particles may be about 10 μm or less, such as about 2 μm to about 5 μm or submicron.

The diamond particle size distribution of the diamond particle may exhibit a single mode, or may be a bimodal or greater grain size distribution. In an embodiment, the diamond particles of the one or more layers of diamond particles 150 may comprise a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the diamond particles may include a portion exhibiting a relatively larger average particle size (e.g., 50 μm, 40 μm, 30 μm, 20 μm, 15 μm, 12 μm, 10 μm, 8 μm) and another portion exhibiting at least one relatively smaller average particle size (e.g., 6 μm, 5 μm, 4 μm, 3 μm, 2 μm, 1 μm, 0.5 μm, less than 0.5 μm, 0.1 μm, less than 0.1 μm). In an embodiment, the diamond particles may include a portion exhibiting a relatively larger average particle size between about 10 μm and about 40 μm and another portion exhibiting a relatively smaller average particle size between about 1 μm and 4 μm. In some embodiments, the diamond particles may comprise three or more different average particle sizes (e.g., one relatively larger average particle size and two or more relatively smaller average particle sizes), without limitation.

It is noted that the as-sintered diamond grain size may differ from the average particle size of the diamond particles prior to sintering due to a variety of different physical processes, such as grain growth, diamond particles fracturing, carbon provided from another carbon source (e.g., dissolved carbon in the metal-solvent catalyst), or combinations of the foregoing.

The first cemented carbide substrate 105 and the one or more layers of diamond particles 150 may be placed in a pressure transmitting medium, such as a refractory metal can embedded in pyrophyllite or other pressure transmitting medium. The pressure transmitting medium, including the first cemented carbide substrate 105 and the one or more layers of diamond particles 150 therein, may be subjected to a first HPHT process using an ultra-high pressure press to create temperature and pressure conditions at which diamond is stable. The temperature of the first HPHT process may be at least about 1000° C. (e.g., about 1200° C. to about 1600° C.) and the pressure of the first HPHT process may be at least 4.0 GPa (e.g., about 5.0 GPa to about 12.0 GPa) for a time sufficient to sinter the diamond particles to form the PCD table 150'. For example, the pressure of the first HPHT process may be about 5 GPa to about 7 GPa and the temperature of the first HPHT process may be about 1150° C. to about 1450° C. (e.g., about 1200° C. to about 1400° C.).

During the first HPHT process, the metal-solvent catalyst cementing constituent from the first cemented carbide substrate 105 may be liquefied and may infiltrate into the diamond particles of the one or more layers of diamond particles 150. The infiltrated metal-solvent catalyst cementing constituent functions as a catalyst that catalyzes initial formation of directly bonded-together diamond grains to form the PCD table 150'.

In an alternative to using the first cemented carbide substrate 105 during sintering of the diamond particles, the PCD table 150' may be formed by placing the diamond particles along with a metal-solvent catalyst (e.g., cobalt powder and/or a cobalt disc) in a pressure transmitting medium, such as a refractory metal can embedded in pyrophyllite or other pressure transmitting medium. The pressure transmitting medium, including the diamond particles and metal-solvent catalyst therein, may be subjected to a first HPHT process using an ultra-high pressure press to create temperature and pressure conditions at which diamond is stable. Such a process will result in the formation of a PCD table 150' separate from any cemented carbide substrate 105.

In embodiments in which the PCD table 150' is formed so as to be metallurgically bonded to a cemented carbide substrate, the PCD table 150' may then be separated from the first cemented carbide substrate 105, as shown in FIG. 2. For example, the PCD table 150' may be separated from the first cemented carbide substrate 105 by grinding and/or lapping away the first cemented carbide substrate 105, electrodischarge machining, or combinations of the foregoing material removal processes.

Whether the first cemented carbide substrate 105 is employed during formation of the PCD table 150' or not, the metal-solvent catalyst may be at least partially removed from the PCD table 150' by immersing the PCD table 150' in an acid, such as aqua regia, nitric acid, hydrofluoric acid, mixtures thereof, or other suitable acid, to form a porous at least partially leached PCD table 150" that allows fluid to flow therethrough (e.g., from one side to another side). For example, the PCD table 150' may be immersed in the acid for about 2 to about 7 days (e.g., about 3, 5, or 7 days) or for a few weeks (e.g., about 4-6 weeks) depending on the process employed. In some embodiments, a residual amount of the metal-solvent catalyst used to catalyze formation of the diamond-to-diamond bonds of the PCD table 150' may still remain even after leaching. For example, the residual metal-solvent catalyst in the interstitial regions may be about 0.5% to about 2% by weight, such as about 0.9% to about 1% by weight.

In embodiments employing the cemented carbide substrate 105, it is noted that because the metal-solvent catalyst is infiltrated into the diamond particles from the cemented carbide substrate 105 including tungsten carbide or other carbide grains cemented with a metal-solvent catalyst (e.g., cobalt, nickel, iron, or alloys thereof), the infiltrated metal-solvent catalyst may carry tungsten therewith, tungsten carbide therewith, another metal therewith, another metal carbide therewith, or combinations of the foregoing. In such embodiments, the PCD table 150' and the at least partially leached PCD table 150" may include such material(s) disposed interstitially between the bonded diamond grains. The tungsten therewith, tungsten carbide therewith, another metal therewith, another metal carbide therewith, or combinations of the foregoing may be at least partially removed by the selected leaching process or may be relatively unaffected by the selected leaching process.

As shown in FIG. 2, the PCD table 150" is placed with the substrate 108 to which the PCD table 150" is to be attached to form an assembly 200. The assembly 200 may be placed in a pressure transmitting medium, such as a refractory metal can embedded in pyrophyllite or other pressure transmitting medium. The pressure transmitting medium, including the assembly 200, may be subjected to a second HPHT process using an ultra-high pressure press to create temperature and pressure conditions at which diamond is stable. The temperature of the second HPHT process may be at least about 1000° C. (e.g., about 1200° C. to about 1600° C.) and the pressure of the second HPHT process may be at least 5.0 GPa (e.g., about 5.0 GPa to about 12.0 GPa) so that the infiltrant (e.g., the metallic cementing constituent) in the cemented carbide substrate 108 is liquefied and infiltrates into the PCD table 150". Upon cooling from the second HPHT process, the partially infiltrated PCD table 102 is bonded to the cemented carbide substrate 108.

As an alternative to using the cemented carbide substrate 108 as an infiltrant source, an infiltrant layer (e.g., a cobalt disc) may be disposed between the cemented carbide substrate 108 and the PCD table 150". In such an embodiment, the infiltrant layer may liquefy and infiltrate into the PCD table 150" during the second HPHT process.

The infiltration depth "h" may be controlled by selection of the maximum temperature, maximum pressure, and total process time of the second HPHT process during which the PCD table 150" attaches to substrate 108. As used herein, total process time includes the time to ramp-up to the maximum temperature, the soak time at the maximum temperature, and the cool down time from the maximum temperature. The second HPHT process conditions are controlled so that the infiltrant from the substrate 108 only partially infiltrates the PCD table 150" to form the PCD table 102 having the first region 110 and the second region 112, respectively in which the interstitial regions of the second region 112 remain unfilled by the infiltrant infiltrated from the substrate 108.

An HPHT process parameter β may be defined to characterize the second HPHT process during which the PCD table 150" attaches to substrate 108. β is defined as $\beta = T \cdot t/P$, where:

T is a maximum temperature of the second HPHT process;

t is the total process time (t) of the second HPHT process; and

P is a maximum internal cell pressure in the pressure transmitting medium used in the second HPHT process.

β may be about 2° C.·h/GPa to about 325° C.·h/GPa, about 5° C.·h/GPa to about 100° C.·h/GPa, about 5° C.·h/GPa to about 35° C.·h/GPa, about 7.5° C.·h/GPa to about 25° C.·h/GPa, about 10° C.·h/GPa to about 20° C.·h/GPa, about 20° C.·h/GPa to about 30° C.·h/GPa (e.g., 24-26° C.·h/GPa), about greater than 28° C.·h/GPa, about 30° C.·h/GPa to about 100° C.·h/GPa, about 50° C.·h/GPa to about 75° C.·h/GPa, about 75° C.·h/GPa to about 150° C.·h/GPa, or about 100° C.·h/GPa to about 200° C.·h/GPa. By controlling T, t, and P of the second HPHT process, the infiltration depth "h" may be controlled so that the PCD table 150" is only partially infiltrated. For a given thickness of the PCD table 150", the infiltration depth "h" may be decreased by increasing P, decreasing T, decreasing t, or combinations thereof. Thus, for a given thickness of the PCD table 150", the infiltration depth "h" may be decreased by decreasing β and increased by increasing β.

In the second HPHT process, in some embodiments, P is about 6 GPa to about 10 GPa, T is about 1250° C. to about 3250° C., and t is about 60 seconds to about 1 hour. In other more specific embodiments for the second HPHT process that will result in partial infiltration of a 3.5-5 mm thick PCD table 150", P is about 6 GPa to about 8 GPa (e.g., about 6.1 GPa to about 7.0 GPa), T is about 1250° C. to about 1500° C., and t is about 60 seconds to about 7 minutes (e.g., about 200-450 seconds) that results in the depth "d" of the second region 112 of the PCD table 102 being at least about a third of the PCD table thickness, about half of the PCD table thickness, or more than half of the PCD table thickness. The time (t) for the second HPHT process is typically longer when a high-pressure belt press is used to apply pressure as opposed to a high-pressure cubic press. Typical times used with a high-pressure cubic pressure are about 200-450 seconds, such as about 300-400 seconds of total process time.

The inventors have unexpectedly found that increasing the pressure (P) during the second HPHT process results in decreased infiltration. As explained above, one theory is infiltration occurs through capillary action, and that the increased pressure (P) increases the viscosity of the infiltrant, allowing the infiltrant to infiltrate into the PCD table 150" a relatively less extent than if a higher pressure (P) is employed. For example, in an embodiment the first HPHT process may be carried out at a pressure of about 6 GPa, while in order to achieve partial infiltration, the second HPHT process may be carried out at a pressure between about 6.2 GPa and about 10 GPa (e.g., about 6.3 GPa to about 8.5 GPa, or about 6.3 GPa to about 7 GPa). The temperature and time period of the first and second processes may otherwise be the same (e.g., 1400° C. for about 400 seconds). Higher pressures may be employed to further decrease the infiltration depth "h" for a given temperature (T), time (t), and thickness of the PCD table 150". In other words, as the pressure (P) increases, the infiltration will be less complete.

In a similar manner, the temperature (T) may be altered from the first process to the second process to achieve a similar result. For example, a decrease in temperature (T) provides a similar effect relative to infiltration depth "h" as an increase in pressure (P). Processing time (t) may also be altered from the first process to the second process to achieve a desired infiltration depth "h". For example, increasing processing time (t) provides a similar effect relative to infiltration depth "h" as a decrease in pressure (P). More than one of the temperature (T), pressure (P), or processing time (t) variables may be changed to achieve a desired infiltration depth "h" and any of the resultant selected depths "d" disclosed herein.

In some embodiments, at least one of the P, T, or t in the second HPHT process are different than an associated P, T, or t used in the first HPHT process used to initially sinter the diamond particles that forms the PCD table 150'.

In some embodiments, the infiltrant that occupies the interstitial regions of the first region 110 of the PCD table 102 may be at least partially removed in a subsequent leaching process using an acid, such as aqua regia, nitric acid, hydrofluoric acid, mixtures thereof, or other suitable acid. Even though the second region 112 is already substantially free of the infiltrant, the inventors have found that leaching may improve the uniformity of the interface 114 between the first region 110 and the second region 112, which may improve thermal stability and/or wear resistance in the finished PDC 100.

The following working examples provide further detail in connection with the specific PDC embodiments described above.

COMPARATIVE EXAMPLE A

A PDC was formed according to the following process. A layer of diamond particles was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate. The thickness of the PCD table of the PDC was about 0.083 inch and an about 0.012 inch chamfer was machined in the PCD table.

Figure 7:
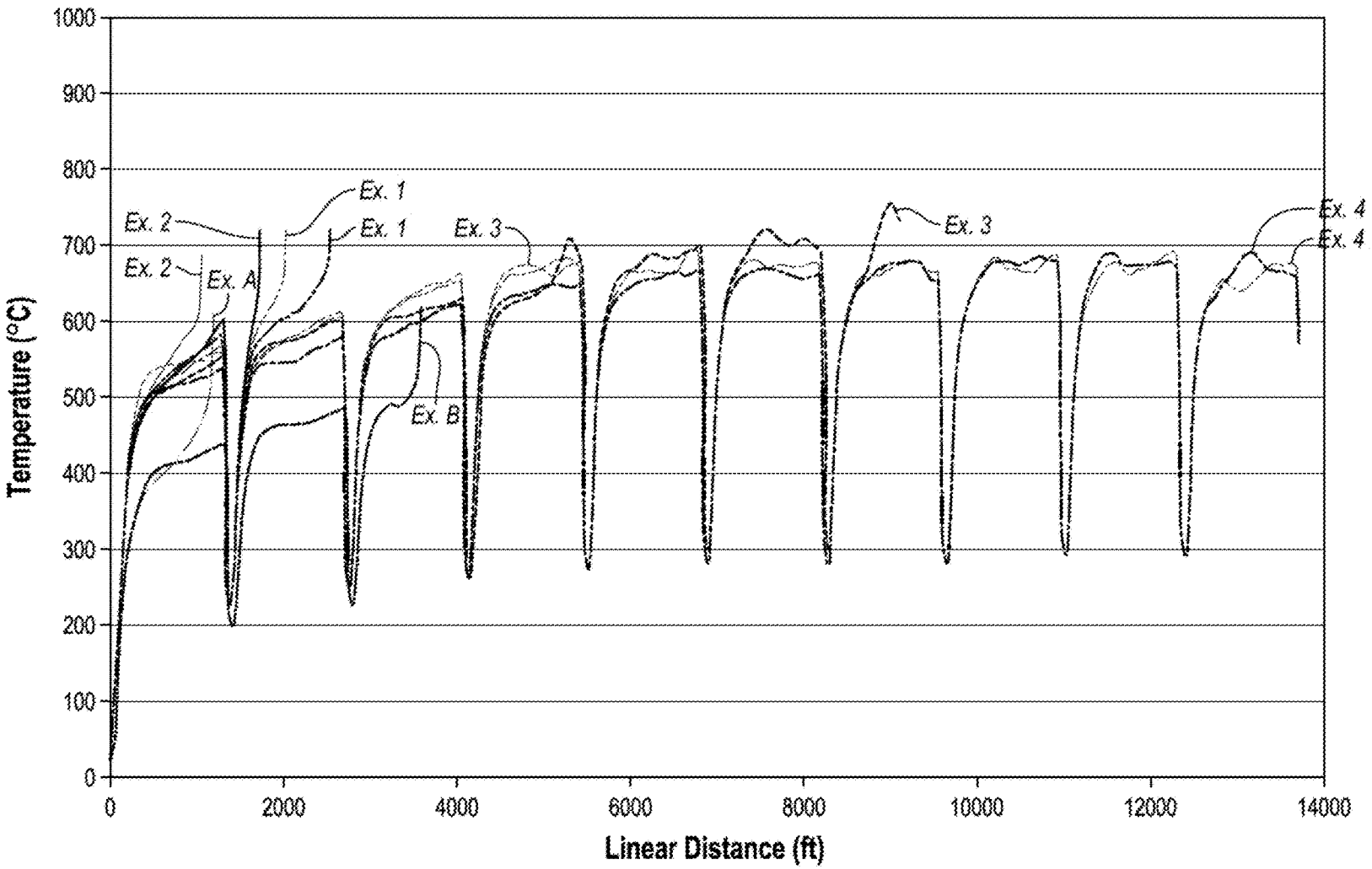
FIG. 7 is a graph showing the measured temperature versus linear distance cut during a vertical turret lathe test on some conventional PDCs and several unleached PDCs according to working examples 1-4 of the present invention.

The thermal stability of the conventional unleached PDC so-formed was evaluated by measuring the distance cut in a Sierra White granite workpiece prior to failure without using coolant in a vertical turret lathe test. The distance cut is considered representative of the thermal stability of the PDC. The conventional unleached PDC was able to cut a distance of only about 1000 linear feet in the workpiece prior to failure. The test parameters were a depth of cut for the PDC of about 1.27 mm, a back rake angle for the PDC of about 20 degrees, an in-feed for the PDC of about 1.524 mm/rev, and a cutting speed of the workpiece to be cut of about 1.78 m/sec. Evidence of failure of the conventional unleached PDC is best shown in FIG. 7 where the measured temperature of the conventional unleached PDC during cutting increased dramatically at about 1000 linear feet.

COMPARATIVE EXAMPLE B

A PDC was formed according to the following process. A layer of diamond particles having the same particle size distribution as comparative example A was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate. The PCD table was subsequently leached to remove cobalt from the interstitial regions between diamond grains within the PCD table to a depth of about 94 μm. The thickness of the PCD table of the PDC was about 0.088 inches and an about 0.012 inch chamfer was machined in the PCD table.

The thermal stability of the conventional leached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. The conventional leached PDC was able to cut a distance of about 3500 linear feet in the workpiece prior to failure. Evidence of failure of the conventional PDC is best shown in FIG. 7 where the measured temperature of the conventional PDC during cutting increased dramatically at about 3500 linear feet.

WORKING EXAMPLE 1

Figure 3:
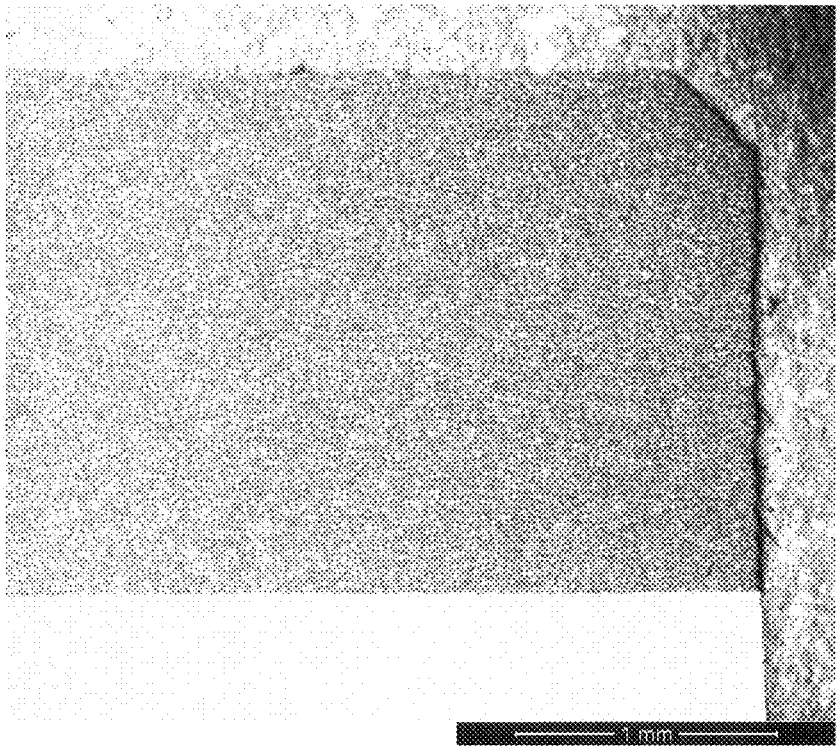
FIG. 3 is a photomicrograph of a PCD table of a PDC formed according to working example 1 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 5.1 GPa for about 250 seconds of soak time (about 400 seconds total process time) at the 1400° C. in a high-pressure cubic press to attach the PCD table to the second tungsten carbide substrate. A scanning electron microscope image (FIG. 3) of the PDC so-formed showed substantially complete infiltration of cobalt from the second cobalt-cemented tungsten carbide substrate into the PCD table.

The thickness of the PCD table of one PDC was about 0.079 inch and an about 0.012 inch chamfer was machined in the PCD table. The thickness of the PCD table of the other PDC was about 0.080 inch and an about 0.013 inch chamfer was machined in the PCD table.

The thermal stability of the unleached PDCs so-formed was evaluated by measuring the distance cut in the same Sierra White granite workpiece as Comparative Example A prior to failure without using coolant in a vertical turret lathe test using the same test parameters. The distance cut is considered representative of the thermal stability of the PDC. One of the unleached PDCs was able to cut a distance of about 2000 linear feet in the workpiece prior to failure. The other unleached PDC was able to cut a distance of about 2500 linear feet in the workpiece prior to failure. Evidence of failure of each PDC is best shown in FIG. 7 where the measured temperature of each PDC during cutting increased dramatically at about 2000 and 2500 linear feet for the two PDCs, respectively.

WORKING EXAMPLE 2

Figure 4:
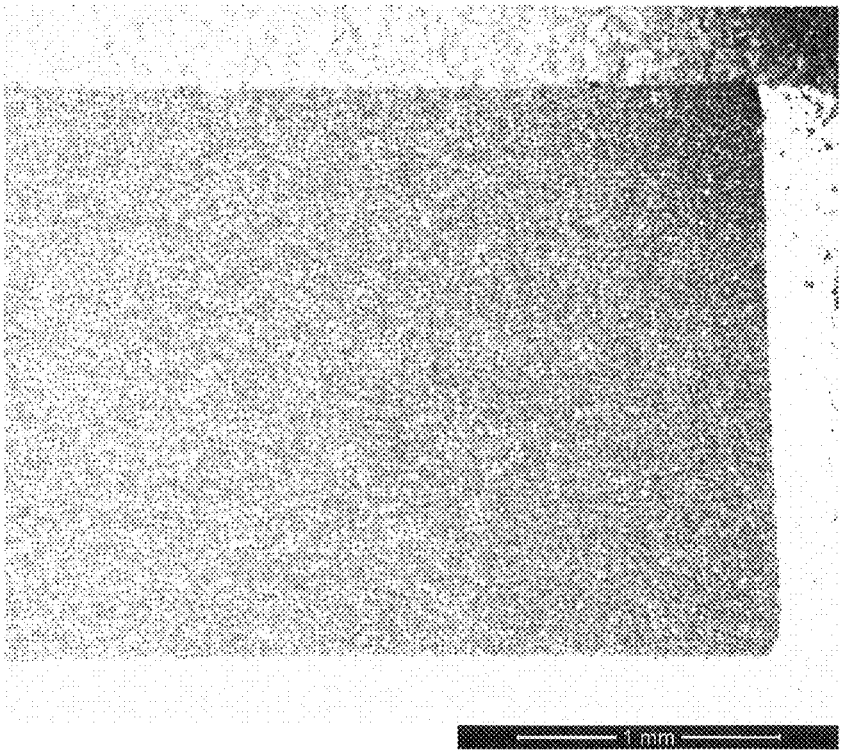
FIG. 4 is a photomicrograph of a PCD table of a PDC formed according to working example 2 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first tungsten carbide substrate by grinding away the first cemented tungsten carbide substrate. The PCD table was leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 5.7 GPa for about 250 seconds of soak time (about 400 seconds total process time) at the 1400° C. temperature in a high-pressure cubic press to attach the PCD table to the second cobalt-cemented tungsten carbide substrate. A scanning electron microscope image (FIG. 4) of the PDC so-formed showed substantially complete infiltration of cobalt from the second cobalt-cemented tungsten carbide substrate into the PCD table.

The thickness of the PCD table of the first PDC was about 0.081 inch and an about 0.012 inch chamfer was machined in the PCD table. The thickness of the PCD table of the second PDC was about 0.079 inch and an about 0.012 inch chamfer was machined in the PCD table.

The thermal stability of the unleached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. One of the unleached PDCs was able to cut a distance of about 1000 linear feet in the workpiece prior to failure. The other was able to cut a distance of about 2000 linear feet in the workpiece prior to failure. Evidence of failure of each PDC is best shown in FIG. 7 where the measured temperature of each PDC during cutting increased dramatically at about 1000 and 2000 linear feet for the two PDCs, respectively.

WORKING EXAMPLE 3

Figure 5:
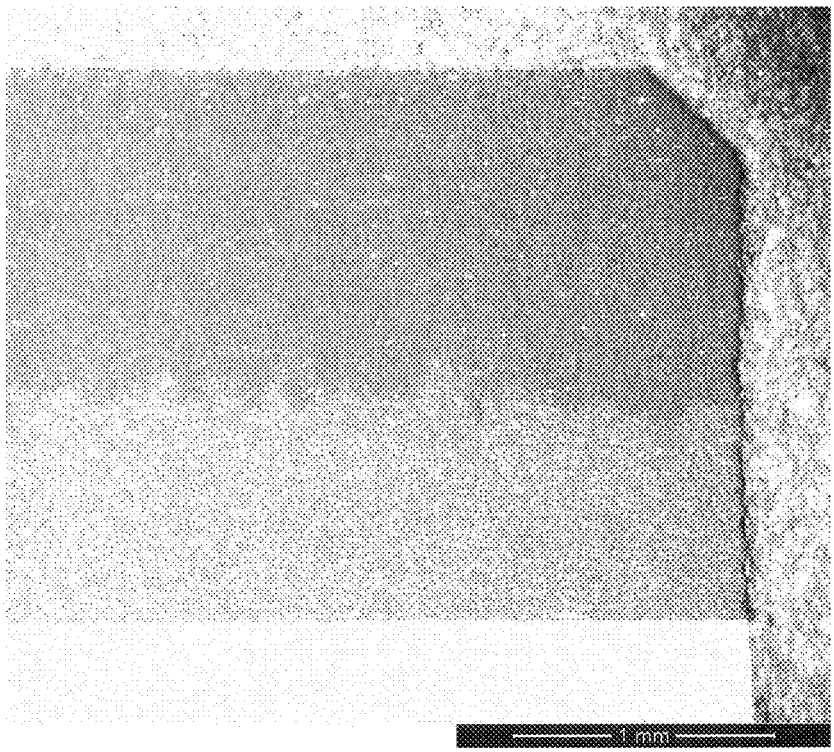
FIG. 5 is a photomicrograph of a PCD table of a PDC formed according to working example 3 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.3 GPa for about 250 seconds of soak time (about 400 seconds total process time) at the 1400° C. temperature in a high-pressure cubic press to attach the PCD table to the second cobalt-cemented tungsten carbide substrate. A scanning electron microscope image (FIG. 5) of one of the PDCs so-formed showed incomplete infiltration of cobalt from the second cobalt-cemented tungsten carbide substrate into the PCD table. Infiltration was only achieved through about half the thickness of the PCD table. Infiltration was less than working example 2, perhaps through only about half of the thickness of the PCD table because the pressure of the second HPHT process was higher, with temperature, time, and PCD table thickness being about the same. The dark region of the PCD table is the un-infiltrated region and the light region of the PCD table is the region infiltrated with cobalt.

The thickness of the PCD table of the first PDC was about 0.081 inch and an about 0.013 inch chamfer was machined in the PCD table. The thickness of the PCD table of the second PDC was about 0.082 inch and an about 0.013 inch chamfer was machined in the PCD table.

The thermal stability of the unleached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. One of the unleached PDCs was able to cut a distance of about 5500 linear feet in the workpiece without failing and without using coolant. The other was able to cut a distance of about 9000 linear feet in the workpiece without failing and without using coolant. This is best shown in FIG. 7 where the distance cut prior to failure of the PDCs of example 3 during cutting of the workpiece is greater than that of the conventional PDC of comparative examples A and B during cutting. Therefore, thermal stability tests indicate that the PDCs of example 3 exhibited a significantly improved thermal stability compared to the conventional unleached PDC of comparative example A, as well as compared to the conventional leached PDC of comparative example B.

WORKING EXAMPLE 4

Figure 6:
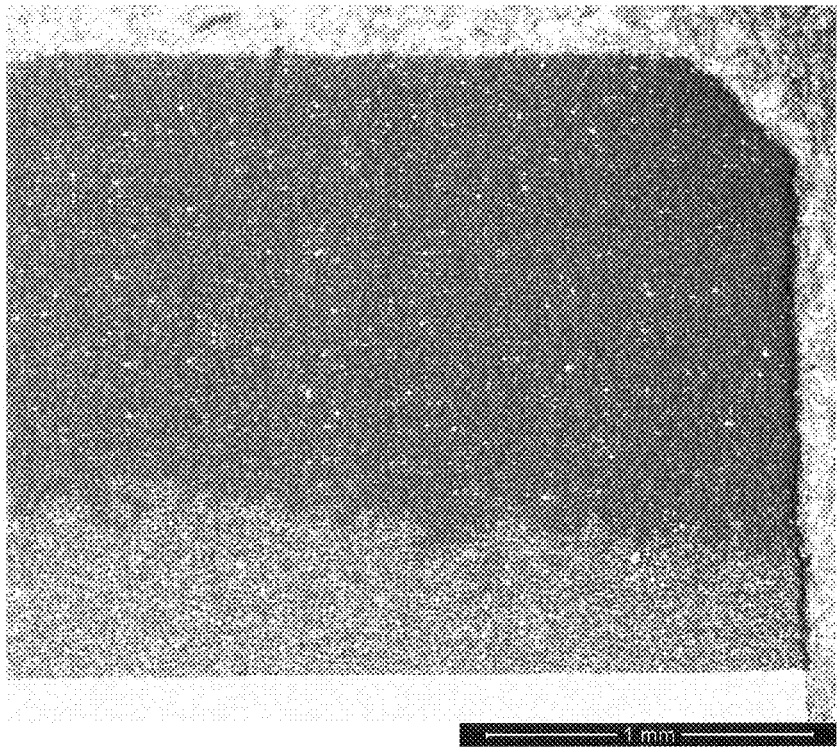
FIG. 6 is a photomicrograph of a PCD table of a PDC formed according to working example 4 of the present invention.

Two PDCs were formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first cobalt-cemented tungsten carbide substrate by grinding away the first cemented tungsten carbide substrate. The PCD table was subsequently leached to remove substantially all of the cobalt from the interstitial regions between diamond grains within the PCD table. The leached PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 7 GPa for about 250 seconds of soak time (about 400 seconds total process time) at the 1400° C. temperature in a high-pressure cubic press to attach the PCD table to the second cobalt-cemented tungsten carbide substrate. A scanning electron microscope image (FIG. 6) of one of the PDCs so-formed showed incomplete infiltration of cobalt from the second cobalt-cemented tungsten carbide substrate into the PCD table. Infiltration was less than working example 3, perhaps through only about one-third the thickness of the PCD table because the pressure of the second HPHT process was higher, with temperature, time and PCD table thickness being about the same. The dark region of the PCD table is the un-infiltrated region and the light region of the PCD table is the region infiltrated with cobalt.

The thickness of the PCD table of the first PDC was about 0.075 inch and an about 0.013 inch chamfer was machined in the PCD table. The thickness of the PCD table of the second PDC was about 0.077 inch and an about 0.013 inch chamfer was machined in the PCD table.

The thermal stability of the unleached PDC so-formed was evaluated by measuring the distance cut in the same Sierra White granite workpiece as Comparative Example A prior to failure without using coolant in a vertical turret lathe test and using the same test parameters. The distance cut is considered representative of the thermal stability of the PDC. Both of the unleached PDCs were able to cut a distance of about 13500 linear feet in the workpiece without failing and without using coolant. This is best shown in FIG. 7 where the distance cut prior to failure of the PDCs of example 4 during cutting of the workpiece is greater than that of the conventional PDCs of comparative examples A and B. Therefore, thermal stability tests indicate that the PDCs of example 4 exhibited a significantly improved thermal stability compared to the conventional unleached PDC of comparative example A, as well as the conventional leached PDC of comparative example B.

Thermal stability tests as shown in FIG. 7 indicate that the PDCs of working examples 3 and 4, particularly example 4, exhibited a significantly improved thermal stability compared to what might be expected even relative to conventional leached PDCs. In particular, because infiltration into the PCD table of examples 3 and 4 is incomplete, leaching after infiltration is not required in order to achieve results similar to or even far superior to a conventional leached PDC.

Wear Resistance of Comparative Examples a and B and Working Examples 1-4

The wear resistance of the PDCs formed according to comparative examples A and B, as well as working examples 1-4 were evaluated by measuring the volume of the PDC removed versus the volume of a Sierra White granite workpiece removed in a vertical turret lathe with water used as a coolant. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

Figure 8:
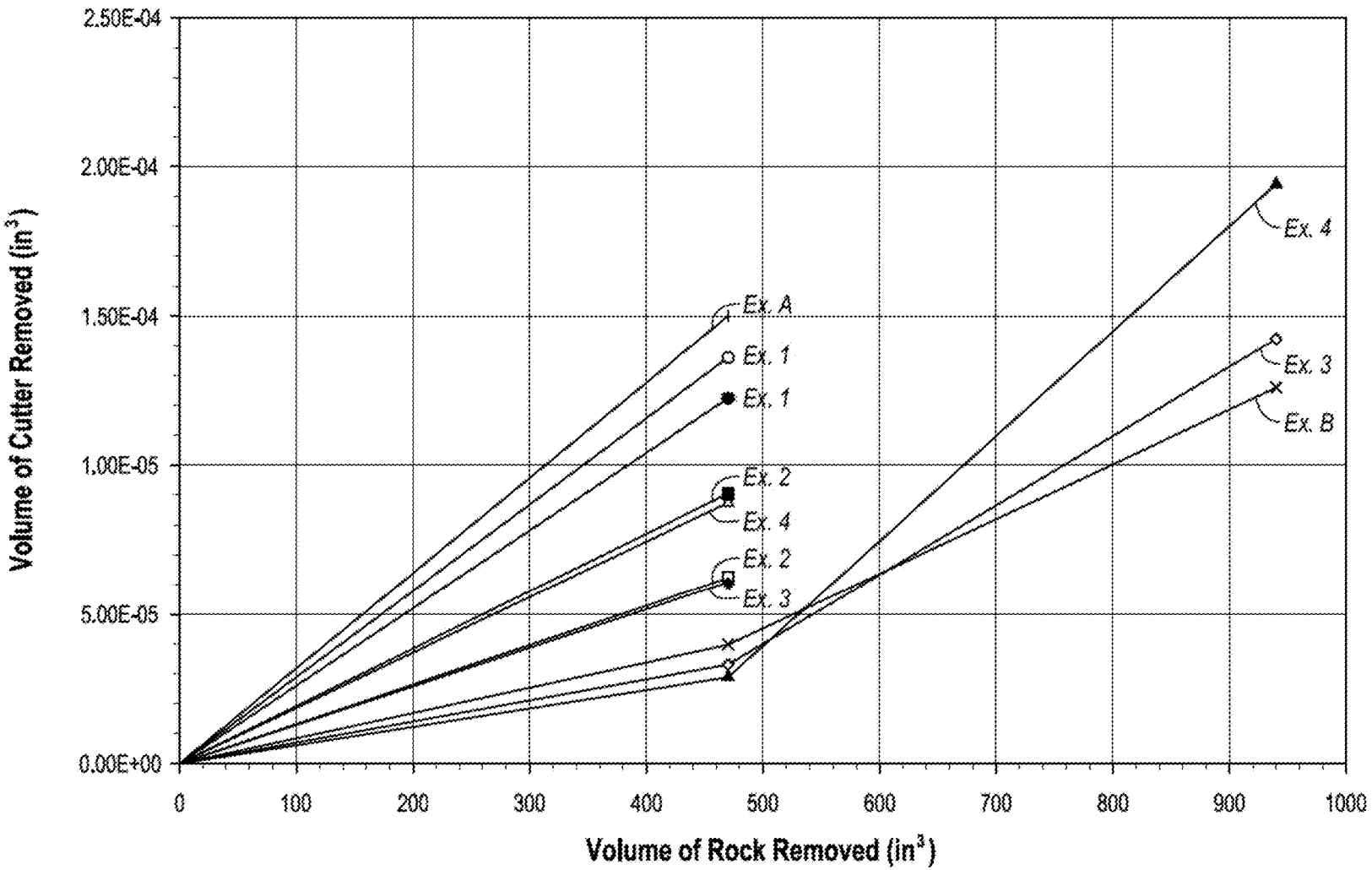
FIG. 8 is a graph showing the wear flat volume characteristics of some conventional PDCs and several unleached PDCs according to working examples 1-4 of the present invention.

As shown in FIG. 8, the wearflat volume tests indicated that the PDCs of unleached examples 1-4 generally exhibited better wear resistance compared to the wear resistance of the unleached PDC of comparative example A. In particular, the unleached PDC of comparative example A exhibited the worst wear resistance, followed by both samples of working example 1. Working examples 1 and 2, which were fully infiltrated and not subsequently leached showed better wear resistance than the unleached PDC of comparative example A. Working examples 3 and 4 were only partially infiltrated and provided even better wear resistance. The wear resistance of working examples 3 and 4 was similar, and in some cases even better, than the leached PDC of comparative example B.

COMPARATIVE EXAMPLE C

A PDC was formed according to the following process. A layer of diamond particles having the same particle size distribution as comparative example A was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate.

Figure 9:
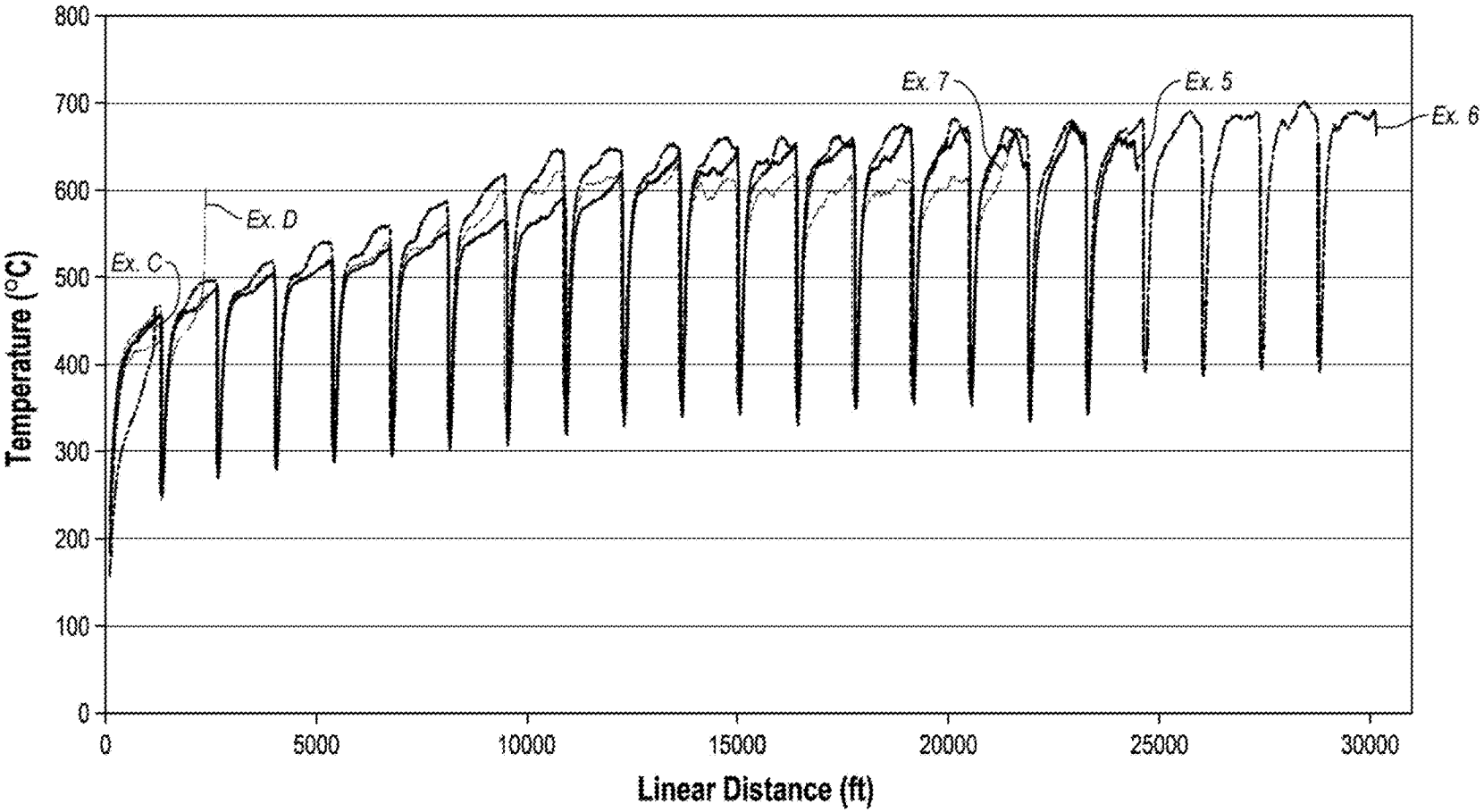
FIG. 9 is a graph illustrating the measured temperature versus linear distance cut during a vertical turret lathe test on some conventional PDCs and several PDCs according to additional working examples 5-7 of the present invention that were leached after reattachment.

The thickness of the polycrystalline diamond table of the PDC was about 0.086 inches and an about 0.012 inch chamfer was machined in the polycrystalline diamond table. The thermal stability of the conventional unleached PDC so-formed was evaluated by measuring the distance cut in a Sierra White granite workpiece prior to failure without using coolant in a vertical turret lathe test using the same test parameters as comparative example A. The distance cut is considered representative of the thermal stability of the PDC. The conventional unleached PDC was able to cut a distance of only about 1000 linear feet in the workpiece prior to failure. Evidence of failure of the conventional unleached PDC is best shown in FIG. 9 where the measured temperature of the conventional unleached PDC during cutting increased dramatically at about 1000 linear feet.

COMPARATIVE EXAMPLE D

A PDC was formed according to the following process. A layer of diamond particles having the same particle size distribution as comparative example A was placed adjacent to a cobalt-cemented tungsten carbide substrate. The diamond particles and the substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the substrate. The PCD table was subsequently leached to remove the cobalt from the interstitial regions between diamond grains within the PCD table to a depth of 78 μm.

The thickness of the PCD table of the PDC was about 0.092 inches and an about 0.013 inch chamfer was machined in the polycrystalline diamond table. The thermal stability of the conventional PDC so-formed was evaluated by measuring the distance cut in the same Sierra White granite workpiece as Comparative Example C prior to failure without using coolant in a vertical turret lathe test. The distance cut is considered representative of the thermal stability of the PDC. The conventional leached PDC was able to cut a distance of about 2000 linear feet in the workpiece prior to failure. Evidence of failure of the conventional PDC is best shown in FIG. 9 where the measured temperature of the conventional PDC during cutting increased dramatically at about 2000 linear feet.

WORKING EXAMPLE 5

A PDC was formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first tungsten carbide substrate by grinding away the first cobalt-cemented tungsten carbide substrate. The PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.1 GPa for about 250 seconds of soak time (about 400 seconds total process time) at the 1400° C. temperature in a high-pressure cubic press to attach the PCD table to the second cobalt-cemented tungsten carbide substrate. Scanning electron microscope images of the PDC so-formed showed incomplete infiltration of cobalt from the second cobalt-cemented tungsten carbide substrate into the PCD table. The PCD was electrically non-conductive prior to leaching. The PCD table was subsequently leached for about 2 hours in nitric acid so as to remove cobalt from the interstitial regions between diamond grains within the PCD table.

The thickness of the PCD table of the PDC was about 0.078 inch and an about 0.012 inch chamfer was machined in the PCD table. The thermal stability of the unleached PDC so-formed was evaluated by measuring the distance cut in the same Sierra White granite workpiece as Comparative Example C prior to failure without using coolant in a vertical turret lathe test. The distance cut is considered representative of the thermal stability of the PDC. The PDC was able to cut a distance of about 24000 linear feet in the workpiece without failing and without using coolant. This is best shown in FIG. 9 where the distance cut prior to failure of the PDC of example 5 during cutting of the workpiece is greater than that of the conventional PDC of comparative examples C and D during cutting. Therefore, thermal stability tests indicate that the PDC of example 5 exhibited a significantly improved thermal stability compared to the conventional PDCs of comparative examples C and D.

WORKING EXAMPLE 6

A PDC was formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first cobalt-cemented tungsten carbide substrate. The PCD table was then separated from the first tungsten carbide substrate by grinding away the first cemented tungsten carbide substrate. The PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.1 GPa for about 250 seconds of soak time (about 400 seconds total process time) at the 1400° C. temperature in a high-pressure cubic press to attach the PCD table to the second tungsten carbide substrate. Scanning electron microscope images of the PDC so-formed showed incomplete infiltration of cobalt from the second cobalt-cemented tungsten carbide substrate into the PCD table. The PCD was electrically non-conductive prior to leaching. The PCD table was subsequently leached for about 2 hours in nitric acid to remove cobalt from the interstitial regions between diamond grains within the PCD table.

The thickness of the polycrystalline diamond table of the PDC was about 0.081 inch and an about 0.012 inch chamfer was machined in the polycrystalline diamond table. The thermal stability of the unleached PDC so-formed was evaluated by measuring the distance cut in the same Sierra White granite workpiece as comparative example C prior to failure without using coolant in a vertical turret lathe test. The distance cut is considered representative of the thermal stability of the PDC. The PDC was able to cut a distance of about 30000 linear feet in the workpiece without failing and without using coolant. This is best shown in FIG. 9 where the distance cut prior to failure of the PDC of example 6 during cutting of the workpiece is greater than that of the conventional PDC of comparative examples C and D during cutting. Therefore, thermal stability tests indicate that the PDC of example 6 exhibited a significantly improved thermal stability compared to the conventional PDCs of comparative examples C and D.

WORKING EXAMPLE 7

A PDC was formed according to the following process. A layer of diamond particles having the same particle size distribution as comparative example A was placed adjacent to a first cobalt-cemented tungsten carbide substrate. The diamond particles and the first cobalt-cemented tungsten carbide substrate were positioned within a pyrophyllite cube, and HPHT processed at a temperature of about 1400° C. and a pressure of about 6 GPa for about 250 seconds of soak time (about 370 seconds total process time) at the 1400° C. temperature in a high-pressure cubic press to sinter the diamond particles and attach the resulting PCD table to the first tungsten carbide substrate. The PCD table was then separated from the first cobalt-cemented tungsten carbide substrate by grinding away the first cemented tungsten carbide substrate. The PCD table was then placed adjacent to a second cobalt-cemented tungsten carbide substrate. The PCD table and the second cobalt-cemented tungsten carbide substrate were positioned within a pyrophyllite cube, and HPHT processed at a temperature of about 1400° C. and a pressure of about 6.1 GPa for about 250 seconds of soak time (about 400 seconds total process time) at the 1400° C. temperature in a high-pressure cubic press to attach the PCD table to the second cobalt-cemented tungsten carbide substrate. Scanning electron microscope images of the PDC so-formed showed incomplete infiltration of cobalt from the second cobalt-cemented tungsten carbide into the PCD table. The PCD was electrically non-conductive prior to leaching. The PCD table was subsequently leached for about 2 hours in nitric acid so as to remove cobalt from the interstitial regions between diamond grains within the PCD table.

The thickness of the polycrystalline diamond table of the PDC was about 0.082 inch and an about 0.012 inch chamfer was machined in the polycrystalline diamond table. The thermal stability of the unleached PDC so-formed was evaluated by measuring the distance cut in the same Sierra White granite workpiece as comparative example C prior to failure without using coolant in a vertical turret lathe test. The distance cut is considered representative of the thermal stability of the PDC. The PDC was able to cut a distance of about 22000 linear feet in the workpiece without using coolant prior to failing. This is best shown in FIG. 9 where the measured temperature of the PDC of example 7 during cutting of the workpiece increases dramatically at about 22000 linear feet. Therefore, thermal stability tests indicate that the PDC of example 7 exhibited a significantly improved thermal stability compared to the conventional PDCs of comparative examples C and D.

Wear Resistance of Comparative Examples C and D and Working Examples 5-7

The wear resistance of PDCs formed according to comparative examples C and D, as well as working examples 5-7 was evaluated by measuring the volume of the PDC removed versus the volume of a Sierra White granite workpiece removed in a vertical turret lathe with water used as a coolant. The test parameters were a depth of cut for the PDC of about 0.254 mm, a back rake angle for the PDC of about 20 degrees, an in-feed for the PDC of about 6.35 mm/rev, and a rotary speed of the workpiece to be cut of about 101 RPM.

Figure 10:
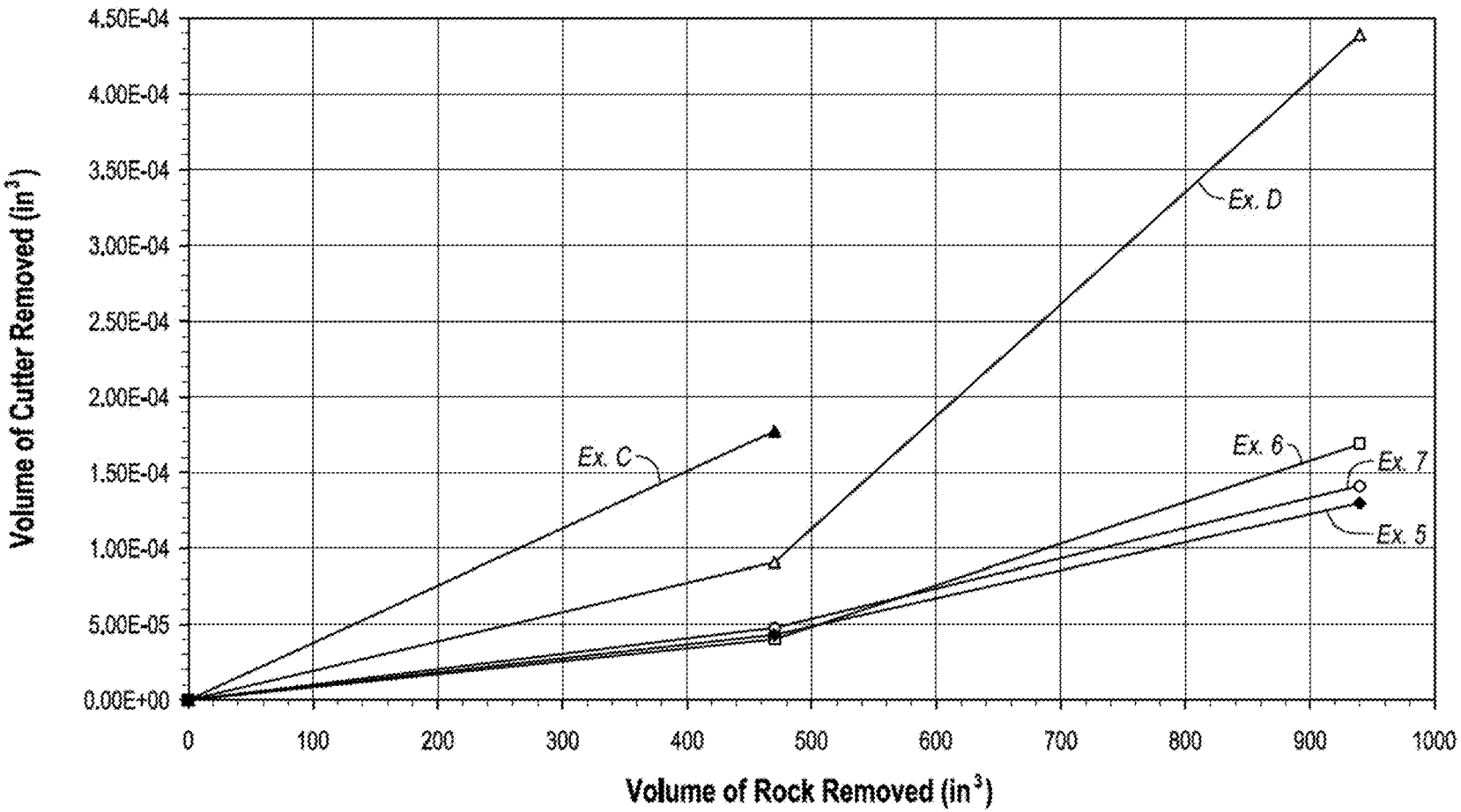
FIG. 10 is a graph illustrating the wear flat volume characteristics of some conventional PDCs and several PDCs according to additional working examples 5-7 of the present invention that were leached after reattachment.

As shown in FIG. 10, the wearflat volume tests indicated that the PDCs of examples 5-7 generally exhibited better wear resistance compared to the wear resistance of the PDC of unleached comparative example C, as well as leached comparative example D. In particular, unleached comparative example C exhibited the lowest wear resistance, followed by comparative example D. Working examples 5 through 7, which were only partially infiltrated and then also subsequently leached, showed better wear resistance than either comparative example C or D. The partial infiltration is believed to result in a more uniform leaching profile during leaching of the PCD table, which may at least partially contributes to the better wear resistance exhibited by working examples 5-7.

The PDCs formed according to the various embodiments disclosed herein may be used as PDC cutting elements on a rotary drill bit. For example, in a method according to an embodiment of the invention, one or more PDCs may be received that were fabricated according to any of the disclosed manufacturing methods and attached to a bit body of a rotary drill bit.

Figure 11:
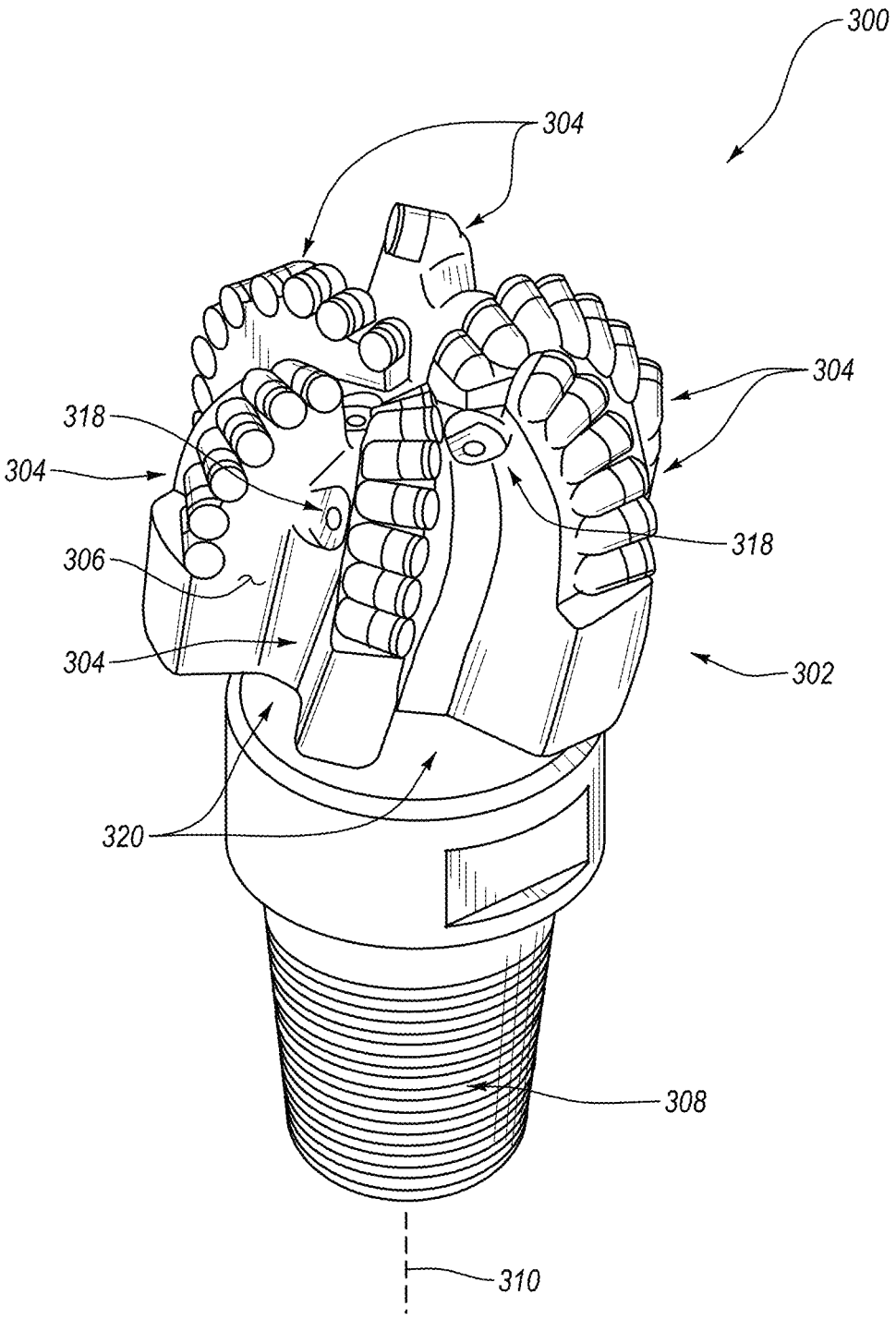
FIG. 11 is an isometric view of an embodiment of a rotary drill bit that may employ one or more of the disclosed PDC embodiments.
Figure 12:
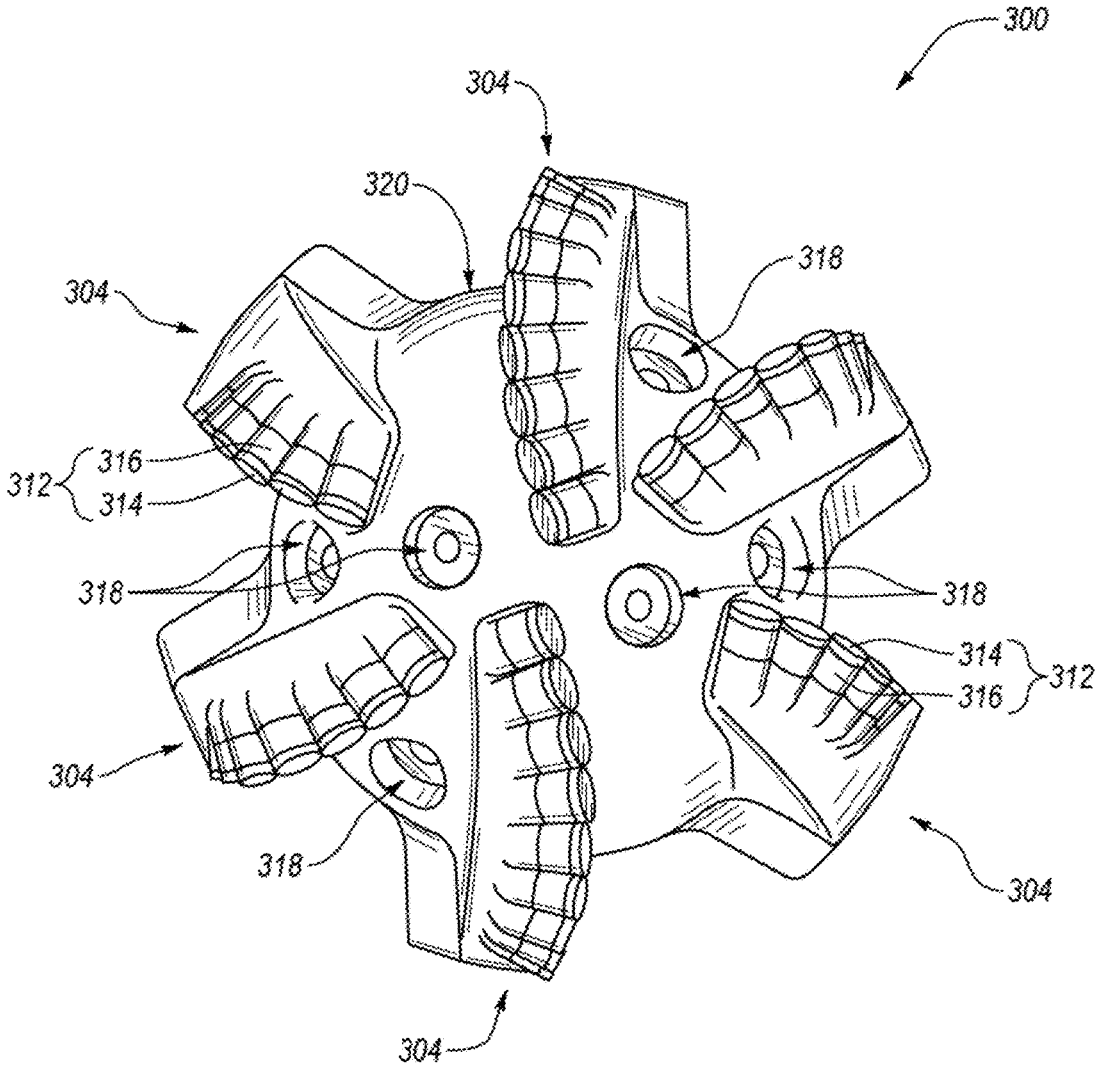
FIG. 12 is a top elevation view of the rotary drill bit shown in FIG. 11.

FIG. 11 is an isometric view and FIG. 12 is a top elevation view of an embodiment of a rotary drill bit 300 that includes at least one PDC configured and/or fabricated according to any of the disclosed PDC embodiments. The rotary drill bit 300 comprises a bit body 302 that includes radially and longitudinally extending blades 304 having leading faces 306, and a threaded pin connection 308 for connecting the bit body 302 to a drilling string. The bit body 302 defines a leading end structure for drilling into a subterranean formation by rotation about a longitudinal axis 310 and application of weight-on-bit. At least one PDC, configured according to any of the previously described PDC embodiments, may be affixed to the bit body 302. With reference to FIG. 12, each of a plurality of PDCs 312 is secured to the blades 304 of the bit body 302 (FIG. 11). For example, each PDC 312 may include a PCD table 314 bonded to a substrate 316. More generally, the PDCs 312 may comprise any PDC disclosed herein, without limitation. For example, in one embodiment, the PCD table 314 may include first and second regions where the region adjacent the upper exterior surface of PCD table 314 was not infiltrated during attachment of the PCD table 314 to the substrate 316. In one such embodiment, the PCD table 314 has not been subjected to a leaching process after attachment of PCD table 314 to substrate 316, although the region adjacent the upper exterior surface may still be substantially void of infiltrant. For example, the region adjacent the upper exterior surface may be essentially free of an infiltrant, such as silicon, a reaction product of silicon such as silicon carbide, nickel, nickel alloys, or combinations of the foregoing. Such an embodiment may provide the same or better wear resistance and/or thermal stability performance of a leached PCD table integrally formed on a substrate (i.e., a one-step PDC) without leaching.

In addition, if desired, in some embodiments, a number of the PDCs 312 may be conventional in construction. Also, circumferentially adjacent blades 304 define so-called junk slots 320 therebetween. Additionally, the rotary drill bit 300 includes a plurality of nozzle cavities 318 for communicating drilling fluid from the interior of the rotary drill bit 300 to the PDCs 312.

FIGS. 11 and 12 merely depict one embodiment of a rotary drill bit that employs at least one PDC fabricated and structured in accordance with the disclosed embodiments, without limitation. The rotary drill bit 300 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIG. 1) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIG. 1) configured according to any of the embodiments disclosed herein and may be operably assembled to a downhole drilling assembly. U.S. Pat. Nos. 4,410,054; 4,560,014; 5,364,192; 5,368,398; 5,480,233; 7,552,782; and 7,559,695, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a substrate; and a polycrystalline diamond table bonded to the substrate and including an upper exterior working surface, at least one lateral surface, and a chamfer extending between the upper exterior working surface and the at least one lateral surface, the polycrystalline diamond table including a plurality of bonded diamond grains defining a plurality of interstitial regions, the plurality of bonded diamond grains exhibiting an average grain size of about 40 μm or less, the polycrystalline diamond table further including:

a first region adjacent to the substrate, at least a portion of the interstitial regions of the first region including cobalt disposed therein; and a second leached region adjacent to the first region and extending inwardly from the upper exterior working surface to a selected depth of at least about 700 μm, the interstitial regions of the second leached region being substantially free of metal-solvent catalyst, the second leached region being partially defined by a boundary that terminates at the at least one lateral surface at a location that is spaced from the chamfer, wherein the boundary partially defining the second leached region is generally horizontal and terminates at the at least one lateral surface;

wherein a cross-section of the second leached region exhibits:

a first depth measured from and substantially perpendicularly to the upper exterior working surface at an intersection of the chamfer and the upper exterior working surface; and a second depth measured from and substantially perpendicularly to the upper exterior working surface at a generally central location on the upper exterior working surface;

wherein the first depth and the second depth are substantially equal.

2. The polycrystalline diamond compact of claim 1 wherein the average grain size of the polycrystalline diamond table is about 30 μm or less.

3. The polycrystalline diamond compact of claim 1 wherein the interstitial regions the second region are substantially void of material.

4. The polycrystalline diamond compact of claim 1 wherein the selected depth is about 750 μm to about 2100 μm.

5. The polycrystalline diamond compact of claim 1 wherein the selected depth is about 1000 μm to about 2000 μm.

6. The polycrystalline diamond compact of claim 1 wherein the average grain size of the polycrystalline diamond table is about 30 μm or less, a thickness of the polycrystalline diamond table is about 0.065 inch to about 0.080 inch, the second leached region of the polycrystalline diamond table is essentially free of silicon, nickel, or combinations thereof.

7. A rotary drill bit, comprising:

a bit body configured to engage a subterranean formation; and a plurality of polycrystalline diamond cutting elements affixed to the bit body, at least one of the polycrystalline diamond cutting elements including:

a substrate; and a polycrystalline diamond table bonded to the substrate and including an upper exterior working surface, at least one lateral surface, and a chamfer extending between the upper exterior working surface and the at least one lateral surface, the polycrystalline diamond table including a plurality of bonded diamond grains defining a plurality of interstitial regions, the plurality of bonded diamond grains exhibiting an average grain size of about 40 μm or less, the polycrystalline diamond table further including:

a first region adjacent to the substrate, at least a portion of the interstitial regions of the first region including cobalt disposed therein; and a second leached region adjacent to the first region and extending inwardly from the upper exterior working surface to a selected depth of at least about 700 μm, the interstitial regions of the second leached region being substantially free of metal-solvent catalyst, the second leached region being partially defined by a boundary that terminates at the at least one lateral surface at a location that is spaced from the chamfer;

wherein a cross-section of the second leached region exhibits:

a first depth measured from and substantially perpendicularly to the upper exterior working surface at an intersection of the chamfer and the upper exterior working surface; and a second depth measured from and substantially perpendicularly to the upper exterior working surface at a generally central location on the upper exterior working surface;

wherein the first depth and the second depth are substantially equal.

8. A rotary drill bit, comprising:

a bit body configured to engage a subterranean formation; and a plurality of polycrystalline diamond cutting elements affixed to the bit body, at least one of the polycrystalline diamond cutting elements including:

a substrate; and a polycrystalline diamond table bonded to the substrate and including an upper exterior working surface, at least one lateral surface, and a chamfer extending between the upper exterior working surface and the at least one lateral surface, the polycrystalline diamond table including a plurality of bonded diamond grains defining a plurality of interstitial regions, the polycrystalline diamond table further including:

a first region adjacent to the substrate, at least a portion of the interstitial regions of the first region including an infiltrant disposed therein; and a second leached region adjacent to the first region and extending inwardly from the upper exterior working surface to a selected depth, the interstitial regions of the second leached region being substantially free of metal-solvent catalyst, the second region being defined by the upper exterior working surface, the at least one lateral surface, the chamfer, and a generally horizontal boundary that terminates at the at least one lateral surface at a location that is spaced from the chamfer;

wherein a cross-section of the second leached region exhibits:

a first depth measured from and substantially perpendicularly to the upper exterior working surface at an intersection of the chamfer and the upper exterior working surface; and a second depth measured from and substantially perpendicularly to the upper exterior working surface at a generally central location on the upper exterior working surface;

wherein the first depth and the second depth are substantially equal.

9. The polycrystalline diamond compact of claim 1 wherein the boundary partially defining the second leached region is an irregular boundary.

10. A polycrystalline diamond compact, comprising:

a substrate; and a polycrystalline diamond table bonded to the substrate and including an upper exterior working surface, at least one lateral surface, and a chamfer extending between the upper exterior working surface and the at least one lateral surface, the polycrystalline diamond table including a plurality of bonded diamond grains defining a plurality of interstitial regions, the plurality of bonded diamond grains exhibiting an average grain size of about 40 μm or less, the polycrystalline diamond table further including:

a first region adjacent to the substrate, at least a portion of the interstitial regions of the first region including cobalt disposed therein; and a second leached region adjacent to the first region and extending inwardly from the upper exterior working surface to a selected depth of at least about 700 μm, the interstitial regions of the second leached region being substantially free of metal-solvent catalyst, the second leached region being partially defined by a boundary that terminates at the at least one lateral surface at a location that is spaced from the chamfer;

wherein a cross-section of the second leached region exhibits:

a first depth measured from and substantially perpendicularly to the upper exterior working surface at an intersection of the chamfer and the upper exterior working surface; and a second depth measured from and substantially perpendicularly to the upper exterior working surface at a generally central location on the upper exterior working surface;

wherein the first depth and the second depth are substantially equal.

11. A polycrystalline diamond compact formed by a process comprising:

forming a polycrystalline diamond table in the presence of a metal-solvent catalyst including one of cobalt, iron, nickel, or alloys thereof in a first high-pressure/high-temperature process, the polycrystalline diamond table including a plurality of bonded diamond grains defining a plurality of interstitial regions, at least a portion of the plurality of interstitial regions including the metal-solvent catalyst disposed therein, the plurality of bonded diamond grains exhibiting an average grain size of about 40 μm or less;

at least partially leaching the polycrystalline diamond table to remove at least a portion of the metal-solvent catalyst therefrom;

subjecting the at least partially leached polycrystalline diamond table and a substrate to a second high-pressure/high-temperature process under diamond-stable temperature-pressure conditions to partially infiltrate the at least partially leached polycrystalline table with an infiltrant including one of iron, nickel, cobalt, or alloys of the foregoing metals and attach the partially infiltrated polycrystalline diamond table to the substrate;

wherein subjecting the at least partially leached polycrystalline diamond table and a substrate to a second high-pressure/high-temperature process forms a first region adjacent to the substrate including the infiltrant disposed in at least a portion of the interstitial regions thereof and a second region extending inwardly from an exterior working surface, the second region being substantially free of the infiltrant without having been leached of the infiltrant, the second leached region being partially defined by a boundary proximate to the chamfer, wherein the boundary partially defining the second leached region is generally horizontal and terminates at the at least one lateral surface;

wherein a cross-section of the second leached region exhibits:

a first depth measured from and substantially perpendicularly to the upper exterior working surface at an intersection of the chamfer and the upper exterior working surface;

and a second depth measured from and substantially perpendicularly to the upper exterior working surface at a generally central location on the upper exterior working surface;

wherein the first depth and the second depth are substantially equal.

* * * * *